US008768197B2

(12) United States Patent
Okabe

(10) Patent No.: US 8,768,197 B2
(45) **Date of Patent: *Jul. 1, 2014**

(54) IMAGE FORMING APPARATUS, IMAGE FORMING CARTRIDGE SUPPORTER, AND IMAGE FORMING UNIT

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/936,528

(22) Filed: Jul. 8, 2013

(65) Prior Publication Data

US 2013/0294796 A1 Nov. 7, 2013

Related U.S. Application Data

(63) Continuation of application No. 13/567,404, filed on Aug. 6, 2012, now Pat. No. 8,483,588, which is a continuation of application No. 13/239,966, filed on Sep. 22, 2011, now Pat. No. 8,249,482, which is a continuation of application No. 12/756,486, filed on Apr. 8, 2010, now Pat. No. 8,041,248, which is a continuation of application No. 11/525,070, filed on Sep. 22, 2006, now Pat. No. 7,711,282.

(30) Foreign Application Priority Data

Sep. 28, 2005 (JP) ..... 2005-281139

(51) Int. Cl.
*G03G 15/00* (2006.01)
*G03G 21/18* (2006.01)

(52) U.S. Cl.
USPC ..... 399/90; 399/112; 399/113

(58) Field of Classification Search
USPC ..... 399/90, 110, 111, 112, 113
See application file for complete search history.

(56) References Cited

U.S. PATENT DOCUMENTS 4,952,989 A 8/1990 Kawano et al.
5,521,693 A 5/1996 Kojima et al.

(Continued)

FOREIGN PATENT DOCUMENTS

CN 1503070 A 6/2004
EP 1273980 A2 1/2003

(Continued)

OTHER PUBLICATIONS

EP Search Report dtd Oct. 16, 2006, EP Appln. 06013842.

(Continued)

*Primary Examiner* — Sandra Brase
(74) *Attorney, Agent, or Firm* — Banner & Witcoff, Ltd.

(57) ABSTRACT

An image forming apparatus has a body frame and a slide frame. The slide frame is configured to be pulled out from the body frame along a sliding direction. A plurality of image forming cartridges is detachably mounted on the slide frame. A plurality of electrode members is mounted on the slide frame and aligned along the sliding direction so as to correspond to the image forming cartridges. A body-side contact portion of each of the electrode members is electrically connected to the body frame. A cartridge-side contact portion of the electrode member is electrically connected to the image forming cartridge. The image forming cartridge is connected to the body via the corresponding electrode member when the slide frame mounting the image forming cartridges is inserted to the body frame.

10 Claims, 20 Drawing Sheets

(56) References Cited

U.S. PATENT DOCUMENTS

| | | | |
|---|---|---|---|
| 5,802,432 | A | 9/1998 | Coffey et al. |
| 5,870,655 | A | 2/1999 | Nishiuwatoko et al. |
| 6,101,349 | A | 8/2000 | Ohashi et al. |
| 6,246,841 | B1 | 6/2001 | Merrifield et al. |
| 6,272,299 | B1 | 8/2001 | Numagami et al. |
| 6,823,160 | B2 | 11/2004 | Okabe |
| 6,944,415 | B2 | 9/2005 | Nomura |
| 6,973,276 | B2 | 12/2005 | Mizoguchi |
| 7,062,192 | B2 | 6/2006 | Oguma et al. |
| 7,072,602 | B2 | 7/2006 | Hatori et al. |
| 7,092,657 | B2 | 8/2006 | Nakashima et al. |
| 7,155,151 | B2 | 12/2006 | Okamoto |
| 7,466,939 | B2 | 12/2008 | Nakashima et al. |
| 7,711,282 | B2 | 5/2010 | Okabe |
| 8,041,248 | B2 | 10/2011 | Okabe |
| 8,249,482 | B2 | 8/2012 | Okabe |
| 2003/0053819 | A1 | 3/2003 | Nomura et al. |
| 2003/0185594 | A1 | 10/2003 | Okabe |
| 2003/0228173 | A1 | 12/2003 | Nittani et al. |
| 2005/0047823 | A1 | 3/2005 | Nakashima et al. |
| 2005/0063735 | A1 | 3/2005 | Okabe |
| 2005/0185980 | A1 | 8/2005 | Okamoto |
| 2006/0210304 | A1 | 9/2006 | Nakashima et al. |
| 2007/0009281 | A1 | 1/2007 | Sato et al. |
| 2007/0009282 | A1 | 1/2007 | Sato et al. |

FOREIGN PATENT DOCUMENTS

| | | | |
|---|---|---|---|
| EP | 1422577 | A2 | 5/2004 |
| JP | 1-282574 | A | 11/1989 |
| JP | 04-337758 | A | 11/1992 |
| JP | 6-051629 | A1 | 2/1994 |
| JP | 9-044061 | A | 2/1997 |
| JP | 10-020743 | A | 12/2002 |
| JP | 2003-295614 | A | 10/2003 |
| JP | 2004-258440 | A | 9/2004 |
| JP | 2005-077440 | A | 3/2005 |

OTHER PUBLICATIONS

International Search Report dtd Oct. 24, 2006, PCT/JP2006/313804.

CN Office Action dtd Jul. 4, 2008, CN App 2006100924768.

JP Office Action dtd Apr. 7, 2009, JP App 2005-376522, partial English translation.

NZ Office Action dtd Sep. 9, 2009, NZ App 565680.

JP Office Action dtd Jan. 12, 2011, JP Appln. 2005-281139, English translation.

IMAGE FORMING APPARATUS, IMAGE FORMING CARTRIDGE SUPPORTER, AND IMAGE FORMING UNIT

CROSS-REFERENCE TO RELATED APPLICATIONS

This application is a continuation of prior U.S. application Ser. No. 13/567,404, filed Aug. 6, 2012, which is a continuation of prior U.S. application Ser. No. 13/239,966, filed Sep. 22, 2011 (now U.S. Pat. No. 8,249,482B2, Aug. 21, 2012), which is a continuation of prior U.S. application Ser. No. 12/756,486, filed Apr. 8, 2010 (now U.S. Pat. No. 8,041,248B2, issued Oct. 18, 2011), which is a continuation of prior U.S. application Ser. No. 11/525,070, filed Sep. 22, 2006 (now U.S. Pat. No. 7,711,282B2, issued May 4, 2010), which claims priority under 35 U.S.C. §119(a) on Patent Application No. 2005-281139, filed in Japan on Sep. 28, 2005, the entire contents of which are hereby incorporated by reference.

BACKGROUND OF THE INVENTION

1. Field of the Invention

The present invention relates to an image forming apparatus that is capable of forming a multicolor image, an image forming cartridge supporter that is capable of being pulled out from the body of the image forming apparatus and supporting a plurality of image forming cartridges, and an image forming unit included in the image forming apparatus.

2. Description of the Related Art

Image forming apparatuses are known that removably include an image forming unit which removably contains a plurality of image forming cartridges.

For example, Japanese Patent Application Laid-Open (kokai) No. 4-337758 describes an image forming apparatus including a main cartridge and a plurality of sub cartridges. The main cartridge is removably attached to the body of the image forming apparatus. The main cartridge includes an image carrier on which an electrostatic latent image is formed. The sub cartridges are removably attached to the main cartridge. The sub cartridges are parts of a developing unit. Each sub cartridge includes a developer carrying member (a development roller).

In this image forming apparatus, each of the sub cartridges is electrically connected to the body of the image forming apparatus via the main cartridge. More specifically, one end of the developer carrying member is in contact with a contact member secured to a contact plate disposed on the main cartridge. Additionally, the contact plate is in contact with a contact provided to the body of the image forming apparatus. Thus, a high-voltage power supply unit provided to the body for applying a developing bias voltage is electrically connected to the developer carrying member so that the developing bias voltage is applied between the image carrier and the developer carrying member.

In the image forming apparatus having such a structure, in order to perform a reliable image forming operation, a reliable electrical connection is required between a power feeding portion (an electrical connection portion) and each of the image forming cartridges. That is, a reliable electrical connection is required between each of the image forming cartridges and the image forming cartridge supporter which is part of the frame of the image forming unit. In addition, a reliable electrical connection is required between the image forming cartridge supporter and the body of the image forming apparatus.

The amounts of consumption of the individual color developer materials are different in the image forming apparatus. Accordingly, every time the developer material of a specific color runs out, it is necessary to pull out the image forming unit from the body, take out the image forming cartridge with the developer material running out from the image forming unit, and do maintenance. To facilitate the maintenance of the image forming apparatus, the image forming cartridge and the image forming cartridge supporter need to be easily removed and mounted.

SUMMARY OF THE INVENTION

Accordingly, it is an object of the present invention to provide an image forming apparatus, an image forming cartridge supporter, and an image forming unit for, when the image forming unit including an image forming cartridge supporter with a plurality of image forming cartridges removably mounted thereon is removably mounted in a body of the image forming apparatus, providing reliable electrical connection in power supply feeding portions of the image forming cartridges and facilitating the maintenance thereof.

In the image forming apparatus according to the present invention, the plurality of image forming cartridges are removably mounted. The image forming apparatus may be configured to form a multicolor image.

The image forming cartridge supporter according to the present invention is configured so as to be capable of being pulled out from the body of the image forming apparatus. Additionally, the image forming cartridge supporter is configured to be capable of supporting the plurality of image forming cartridges.

The plurality of image forming cartridges is removably mounted in the image forming unit according to the present invention. Additionally, the image forming unit can be accommodated in the image forming apparatus capable of forming a multicolor image.

(1) According to the present invention, the image forming apparatus includes a body frame, a slide frame, and a plurality of electrode members. In addition, the image forming cartridge supporter includes the slide frame and the plurality of electrode members. Furthermore, the image forming unit includes the slide frame and the plurality of electrode members.

The body frame is a member configured to comprise the body of the image forming apparatus. The slide frame is supported by the body frame so as to be capable of being pulled out from the body frame in a first direction. The image forming cartridges are aligned along the first direction and are mountable on and dismountable from the slide frame in a second direction that crosses the first direction.

The electrode members are mounted on the slide frame. The electrode members are aligned along the first direction so as to correspond to the image forming cartridges in a one-to-one fashion. Each of the electrode members includes a body-side contact portion and a cartridge-side contact portion.

The body-side contact portion is disposed so as to protrude towards the body frame. The body-side contact portion is in contact with a body frame contact provided on the body frame so as to be electrically connected to the body frame contact.

The cartridge-side contact portion is disposed so as to protrude towards the image forming cartridge. The cartridge-side contact portion is in contact with an image forming cartridge contact provided on the image forming cartridge so as to be electrically connected to the image forming cartridge contact.

In such a structure, when the slide frame is pulled out from the body frame in the first direction, the physical contact between the body-side contact portion on the slide frame and the body frame contact on the body frame is released. Thus, the electrical connection between the body-side contact portion and the body frame contact is released. In addition, when the image forming cartridge is pulled out from the slide frame in the dismounting direction, the physical contact between the cartridge-side contact portion on the slide frame and the image forming cartridge contact on the image forming cartridge is released. Thus, the electrical connection between the cartridge-side contact portion and the image forming cartridge contact is released.

In contrast, when the slide frame is inserted into the body frame along the first direction and is mounted on the body frame in a predetermined state, the body-side contact portion protruding towards the body frame is brought into contact with the body frame contact. Thus, the body-side contact portion is electrically connected to the body frame contact. Furthermore, the image forming cartridge is inserted into the slide frame in the mounting direction and is mounted on the slide frame, the cartridge-side contact portion is brought into contact with the image forming cartridge contact. Accordingly, the cartridge-side contact portion is electrically connected to the image forming cartridge contact. In this way, the body frame (the body frame contact) is electrically connected to the image forming cartridge (the image forming cartridge contact) via the electrode member including the body-side contact portion and the cartridge-side contact portion.

As noted above, in this structure, by simply mounting the slide frame on the body frame, electrical connection between the body and the image forming cartridge mounted on the slide frame is achieved. In addition, in this structure, by simply pulling out the slide frame from the body frame along the first direction, the electrical connection between the body and the image forming cartridge is released. Furthermore, in this structure, the first directions in which the slide frame is mounted on and dismounted from the body frame cross the second direction in which the image forming cartridge is mounted on and dismounted from the slide frame.

The advantages of this structure are as follows. According to this structure, the relative movement between the body of the image forming apparatus and the image forming cartridge supporter (the image forming unit) along the first direction is synchronized with the open and close of the electrical connection. Accordingly, the electrical connection between the body and the image forming cartridge is easily achieved by means of a simple structure. Thus, according to this structure, the maintenance of the image forming apparatus is facilitated.

Furthermore, according to this structure, as noted above, since the first direction crosses the second direction, changes in a mounting state of the image forming cartridge with respect to the slide frame can be inhibited when the slide frame slides in the first direction. Accordingly, when the slide frame is inserted into the body frame in the first direction, a loose electrical connection between the cartridge-side contact portion of the electrode member and the image forming cartridge contact caused by a positional shift of the slide frame from the image forming cartridge can be inhibited. Consequently, a reliable electrical connection between the body of the image forming apparatus and the image forming cartridge can be achieved. (1') Here, for example, it is desirable that the first direction is substantially perpendicular to the second direction (at an angle of about 50° to about 130°).

Also, it is desirable that the cartridge-side contact portion is disposed inside the slide frame.

In such a structure, the cartridge-side contact portion is disposed so as to protrude from inside the slide frame towards the image forming cartridge. That is, the cartridge-side contact portion of the electrode member for electrical connection with the image forming cartridge that is disposed inside the slide frame is accommodated in a space inside the slide frame. Additionally, the protrusion of the electrode member that protrudes outwardly from the slide frame can be limited to the body-side contact portion for electrical connection with the body that is outside of the slide frame.

In such a structure, mechanical interference between the body frame contact provided on the body frame and the cartridge-side contact portion is inhibited. Thus, in this structure, reliable electrical connection between the body and the slide frame and reliable electrical connection between the slide frame and the image forming cartridge can be achieved. (1") The slide frame may be configured so as to be removable from the body frame. That is, the image forming cartridge supporter (the image forming cartridge unit) may be completely detached from the body. In other words, the image forming cartridge supporter (the image forming cartridge unit) may be configured so as to be interchangeable.

According to this structure, the maintenance of the image forming apparatus can be facilitated. (2) The slide frame may include a guiding portion formed thereon guiding the image forming cartridge in the second direction, and the cartridge-side contact portion may be disposed so as to face the guiding portion.

In such a structure, when the image forming cartridge is mounted on the slide frame, the image forming cartridge is guided by the guiding portion in the second direction. After the image forming cartridge is mounted on the slide frame, the image forming cartridge contact provided on the image forming cartridge is in contact with the cartridge-side contact portion that is disposed so as to face the guiding portion. Accordingly, electrical connection between the image forming cartridge contact and the cartridge-side contact portion is achieved.

According to this structure, the advantages are as follows. In this structure, the image forming cartridge is guided by the guiding portion, and therefore, electrical connection between the image forming cartridge contact and the cartridge-side contact portion that is disposed so as to face the guiding portion is achieved. Accordingly, the reliability of the electrical connection can be improved.

(3) The slide frame may include a pair of side panels disposed parallel to both the first direction and the second direction, and the guiding portion may include a guide groove formed on the side panel.

In such a structure, when the image forming cartridge is mounted on the slide frame, the image forming cartridge is inserted into a space surrounded by the pair of side panels. At that time, the image forming cartridge is guided by the guide groove along the second direction.

According to this structure, the advantages are as follows. In this structure, the image forming cartridge is guided by the guiding groove, and therefore, electrical connection between the image forming cartridge contact and the cartridge-side contact portion that is disposed so as to face the guiding groove is achieved. Accordingly, the reliability of the electrical connection can be improved by means of a simple structure.

(4) The electrode member may include a wire-shaped connecting portion that connects the body-side contact portion to the cartridge-side contact portion and may be disposed in the vicinity of the guide groove on the side panel.

According to this structure, the advantages are as follows. In this structure, the electrode member that electrically connects the body of the image forming apparatus to the image forming cartridge can be formed as a significantly simple structure. Additionally, since the electrode member is disposed in the vicinity of the guide groove, electrical connection between the image forming cartridge contact and the cartridge-side contact portion that is disposed so as to face the guiding groove is reliably achieved.

(5) The connecting portion and the cartridge-side contact portion may be integrated into a wire-like member having a shape of a torsion coil spring, and the cartridge-side contact portion may be formed from an arm portion extending outwardly from a coil portion in the shape of the torsion coil spring.

In such a structure, since the image forming cartridge contact presses the arm portion against the elastic force of the torsion coil spring, physical contact and electrical connection between the arm portion (the cartridge-side contact portion) and the image forming cartridge contact are achieved.

According to this structure, the advantages are as follows. In this structure, the electrode member that electrically connects the body of the image forming apparatus to the image forming cartridge can be formed as a significantly simple structure. Additionally, due to the elastic force of the torsion coil spring, physical contact and establishment of electrical connection between the cartridge-side contact portion and the image forming cartridge contact can be reliably achieved.

(6) The image forming cartridge contact may include a conductive protrusion that is formed so as to be accommodated in the guide groove, and the cartridge-side contact portion may be in contact with the protrusion so as to be electrically connected to the protrusion.

In such a structure, when the image forming cartridge is mounted on the slide frame, the protrusion is accommodated in the guide groove. Accordingly, the image forming cartridge is guided by the guide groove, and the protrusion is brought into contact with the cartridge-side contact portion. Thus, electrical connection between the protrusion and the cartridge-side contact portion is achieved.

According to this structure, the advantages are as follows. In this structure, the image forming cartridge can be smoothly mounted on the slide frame by means of a significantly simple structure. Additionally, reliable electrical connection between the image forming cartridge and the cartridge-side contact portion can be achieved by means of a significantly simple structure.

(7) The image forming cartridge may include a development roller disposed so as to face an image carrier on which an electrostatic latent image is formed, and the protrusion may be formed from a conductive synthetic resin collar member that covers the metallic center shaft protruding from an end of the development roller in the length direction of the development roller.

In such a structure, when the image forming cartridge is mounted on the slide frame, the collar member is accommodated in the guide groove. Accordingly, the image forming cartridge is guided by the guide groove, and the collar member is brought into contact with the cartridge-side contact portion. Thus, electrical connections between the cartridge-side contact portion and the collar member and between the cartridge-side contact portion and the development roller are achieved.

According to this structure, reliable electrical connection between the development roller and the cartridge-side contact portion can be achieved by means of a significantly simple structure.

(8) The side panel may be separated into a plurality of sections, which correspond to the image forming cartridges and are aligned along the first direction, and a supporting plate is disposed outside the plurality of sections so as to support the plurality of sections. Also, the body-side contact portion may be disposed so as to pass through the supporting plate and so as to be exposed to outside the supporting plate.

According to this structure, the side plate and the guide groove can be produced by means of a significantly simple manufacturing process at low cost.

(9) A driving force may be transferred from the body frame to one end of the image forming cartridge in a third direction that is perpendicular to the first direction and the second direction, and the electrode member may be disposed so as to face the other end of the image forming cartridge.

In such a structure, the driving force is transferred from the body frame to one end of the image forming cartridge in the third direction. In contrast, electrical connection between the image forming cartridge and the body is achieved at the other end of the image forming cartridge in the third direction via the electrode member.

According to this structure, the advantages are as follows. In this structure, even when foreign materials, such as dust and grease, are generated on a portion to which the driving force is transferred, deposition of the foreign materials to electrical contacts between the electrode member and the image forming cartridge contact and between the electrode member and the body frame contact can be reliably inhibited. Accordingly, reliable electrical connection at the electrical contacts can be achieved.

(10) The electrode member may be configured as follows: the cartridge-side contact portion is pressed in a third direction crossing the second direction so as to be in contact with the image forming cartridge contact. Additionally, the body-side contact portion is pressed in a fourth direction crossing the first direction so as to be in contact with the body frame contact.

In such a structure, the cartridge-side contact portion is pressed in the third direction crossing the first direction. Accordingly, the body-side contact portion is brought into contact with the body frame contact. Additionally, the cartridge-side contact portion is pressed in the fourth direction crossing the second direction. Accordingly, the cartridge-side contact portion is brought into contact with the image forming cartridge contact.

According to this structure, the advantages are as follows. In this structure, the first direction in which the slide frame is inserted into the body frame crosses the fourth direction in which the body frame contact is pressed by the body-side contact portion. Accordingly, reliable electrical connection between the body frame contact and the body-side contact portion can be achieved by means of a simple structure.

Furthermore, according to this structure, the second direction along which the image forming cartridge moves relative to the slide frame when the image forming cartridge is mounted and dismounted crosses the third direction in which the cartridge-side contact portion is pressed by the image forming cartridge contact. Accordingly, the mount and dismount operation of the image forming cartridge is not affected by the pressure between the cartridge-side contact portion and the image forming cartridge contact. Accordingly, the mount and dismount operation of the image forming cartridge can be smoothly carried out. In addition, reliable electrical connection between the cartridge-side contact portion and the image forming cartridge contact can be achieved by means of a simple structure.

(11) The electrode member may be configured so that the third direction crosses the fourth direction.

According to this structure, when the image forming cartridge is mounted on the slide frame along the second direction, the cartridge-side contact portion and the image forming cartridge contact press each other. Thus, electrical connection between the cartridge-side contact portion and the image forming cartridge contact is achieved. Thereafter, the slide frame is inserted into the body frame along the first direction and is mounted on the body frame. At that time, the body-side contact portion and the body frame contact press each other in the fourth direction crossing the third direction in which the cartridge-side contact portion and the image forming cartridge contact press each other. Thus, electrical connection between the body-side contact portion and the body frame contact is achieved. In this way, electrical connection between the body frame (the body frame contact) and the image forming cartridge (the image forming cartridge contact) can be achieved via the electrode member including the body-side contact portion and the cartridge-side contact portion.

According to this structure, the advantages are as follows. In this structure, the size of the apparatus can be reduced, compared with the case where the third direction in which the cartridge-side contact portion and the image forming cartridge contact press each other is parallel to the fourth direction in which the body-side contact portion and the body frame contact press each other.

Additionally, when the body-side contact portion and the cartridge-side contact portion for one image forming cartridge are integrated into one component, the direction of a pressing force exerted on the body-side contact portion crosses the direction of a pressing force exerted on the cartridge-side contact portion. Accordingly, interference between the pressing force exerted on the body-side contact portion and the pressing force exerted on the cartridge-side contact portion can be inhibited. Consequently, unreliable electrical connections at the body-side contact portion and the cartridge-side contact portion can be inhibited. As a result, reliable electrical connection between the cartridge-side contact portion and the image forming cartridge contact can be achieved by means of a simple structure.

(12) The image forming cartridge and the slide frame may have structures in which the image forming cartridge is pressed in a sixth direction along the third direction which the cartridge-side contact portion and the image forming cartridge contact press each other (hereinafter also referred to as a "pressing direction") so that the position of the image forming cartridge relative to the slide frame is determined.

According to this structure, when the image forming cartridge is pressed in the sixth direction, the position of the image forming cartridge relative to the slide frame is determined. At that time, the image forming cartridge contact provided on the image forming cartridge and the cartridge-side contact portion provided on the slide frame press each other along the sixth direction.

There are following two cases: the sixth direction is equal to the pressing direction; and the sixth direction is equal to the direction opposite the pressing direction.

According to this structure, the advantages are as follows. In the case where the sixth direction is equal to the pressing direction, since the sixth direction is equal to the pressing direction, the reliable positioning can be achieved. In the case where the sixth direction is equal to the direction opposite the pressing direction, when the position of the image forming cartridge relative to the slide frame is determined, the image forming cartridge contact and the cartridge-side contact portion press each other so that electrical connection between the image forming cartridge contact and the cartridge-side contact portion is achieved. Consequently, reliable electrical connection caused by the contact between the image forming cartridge contact and the cartridge-side contact portion can be achieved by means of a simple structure.

(13) The sixth direction may be along a seventh direction in which the image forming cartridge receives a force from the body frame when the image forming cartridge carries out an image forming operation.

In such a structure, when the image forming cartridge carries out an image forming operation, the image forming cartridge is pressed in the seventh direction which is along the sixth direction. Thus, the position of the image forming cartridge relative to the slide frame is determined. At that time, the image forming cartridge contact provided on the image forming cartridge and the cartridge-side contact portion provided on the slide frame press each other along the sixth direction.

According to this structure, the advantages are as follows. In this structure, when the image forming cartridge carries out an image forming operation, by using the force received by the image forming cartridge from the body frame, positioning between the image forming cartridge and the slide frame (and electrical connection between the image forming cartridge contact and the cartridge-side contact portion) can be reliably achieved in a simple structure.

(14) The number of the plurality of the electrode members may be equal to the number of the plurality of image forming cartridges.

In such a structure, the electrode members that electrically connect the body of the image forming apparatus to the plurality of image forming cartridges can be formed by means of a significantly simple structure.

(15) A plurality of image carriers may be disposed in the slide frame. In such a case, the image forming cartridge may be disposed so as to face one of the image carriers and develop an electrostatic latent image formed on a peripheral surface of the corresponding image carrier when the image forming cartridge is mounted in the slide frame. Here, the image carrier has a cylindrical shape and is disposed along a third direction that is perpendicular to both the first direction and the second direction. Additionally, the image carriers are aligned along the first direction so as to correspond to the image forming cartridges in a one-to-one fashion. Each of the image carriers is rotatably supported by the slide frame.

In such a structure, the image forming cartridge is inserted into the slide frame along the second direction and is mounted on the slide frame. At that time, physical contact and electrical connection between the cartridge-side contact portion and the image forming cartridge contact is achieved. In addition, the image forming cartridge is disposed so as to face the image carrier. Thus, the image forming cartridge can develop the electrostatic latent image formed on the peripheral surface of the image carrier.

DESCRIPTION OF THE PREFERRED EMBODIMENTS

Preferred embodiments of the present invention (what the inventor believes to be the best mode for practicing the present invention at the time this application was filed) are described with reference to the accompanying drawings.

Outline of Architecture of Color Laser Printer

Figure 1:
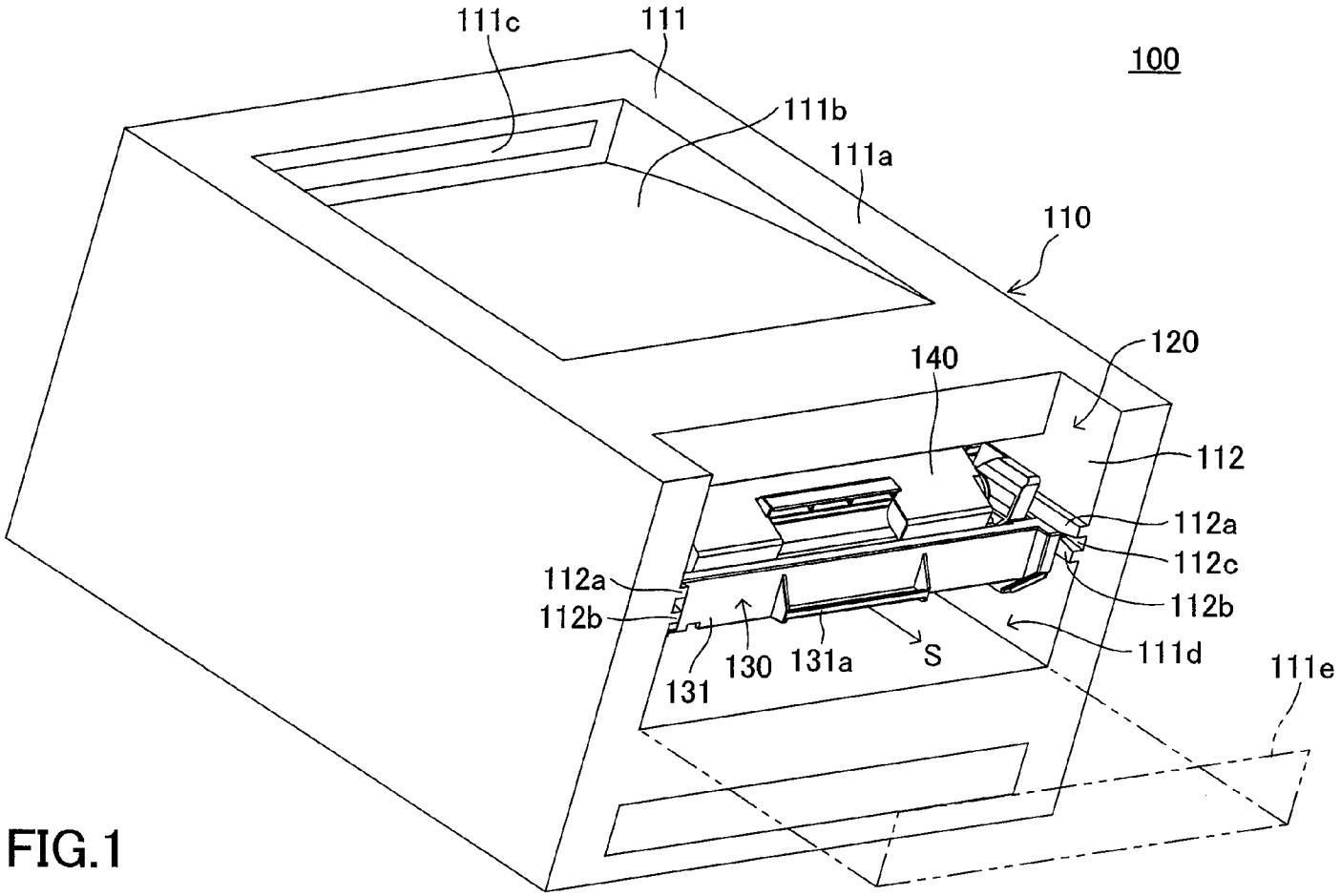
FIG. 1 is a perspective view of the appearance of a color laser printer, which is an image forming apparatus according to an embodiment of the present invention.

FIG. 1 is a perspective view of a color laser printer 100, which is an image forming apparatus according to an embodiment of the present invention.

A body section 110, which defines a body of the color laser printer 100, includes a body casing 111 and a body frame 112 accommodated in the body casing 111.

The body casing 111 has a parallelepiped shape formed from synthetic resin plates. A catch tray 111*b* is formed to the top surface 111*a* of the body casing 111. The catch tray 111*b* includes a part of the top surface 111*a* that slopes downward from the front side (proximal side) to the back side (distal side) thereof. That is, a recess formed on the top surface 111*a* functions as the catch tray 111*b*. A paper ejection port 111*c*, which is an opening, is formed on the upper portion of the body casing 111 and above the lower end of the catch tray 111*b*. The catch tray 111*b* can hold a paper sheet ejected from the paper ejection port 111*c*.

A front opening 111*d* is formed on the front side of the body casing 111. In addition, a planar front cover 111*e* is attached to the front side of the body casing 111 so as to cover the front opening 111*d*. The front cover 111*e* is supported in a pivotal manner about the lower end thereof.

The body frame 112 supports a variety of parts accommodated in the body section 110 and needed for an image forming operation. The body frame 112 includes a driving source and a driving force transmission mechanism for rotatably driving the above-described parts.

In the interior of the body frame 112, a pair of upper guide rails 112*a* and a pair of lower guide rails 112*b* extend inwardly. The upper guide rails 112*a* have a length direction which is indicated by arrow S (a sliding direction). The sliding direction corresponding to the first direction in the present invention is substantially parallel to the fore-aft direction of the color laser printer 100. The upper guide rails 112*a* are aligned along a width direction of the color laser printer 100 (i.e., a direction perpendicular to the sliding direction and the vertical direction) so as to extend towards inside the color laser printer 100. The lower guide rails 112*b* are disposed so as to be substantially parallel to the upper guide rails 112*a*. An image-forming-unit removal guide groove 112*c* is formed between the upper guide rail 112*a* and the lower guide rail 112*b* on either side.

A color image forming unit 120 is accommodated in the body frame 112. The color image forming unit 120 includes a slide frame 130 and an image forming cartridge 140. The slide frame 130 serves as a member (an image forming cartridge supporter) for supporting the image forming cartridge 140. The image forming cartridge 140 is supported by the body frame 112 so as to be pulled out from the body frame 112 in the sliding direction (the direction indicated by arrow S). A front beam 131 of the slide frame 130 is disposed so as to face the front opening 111*d*. A front-side grip 131*a* is formed on the proximal side of the front beam 131 (i.e., the front side).

Figure 2:
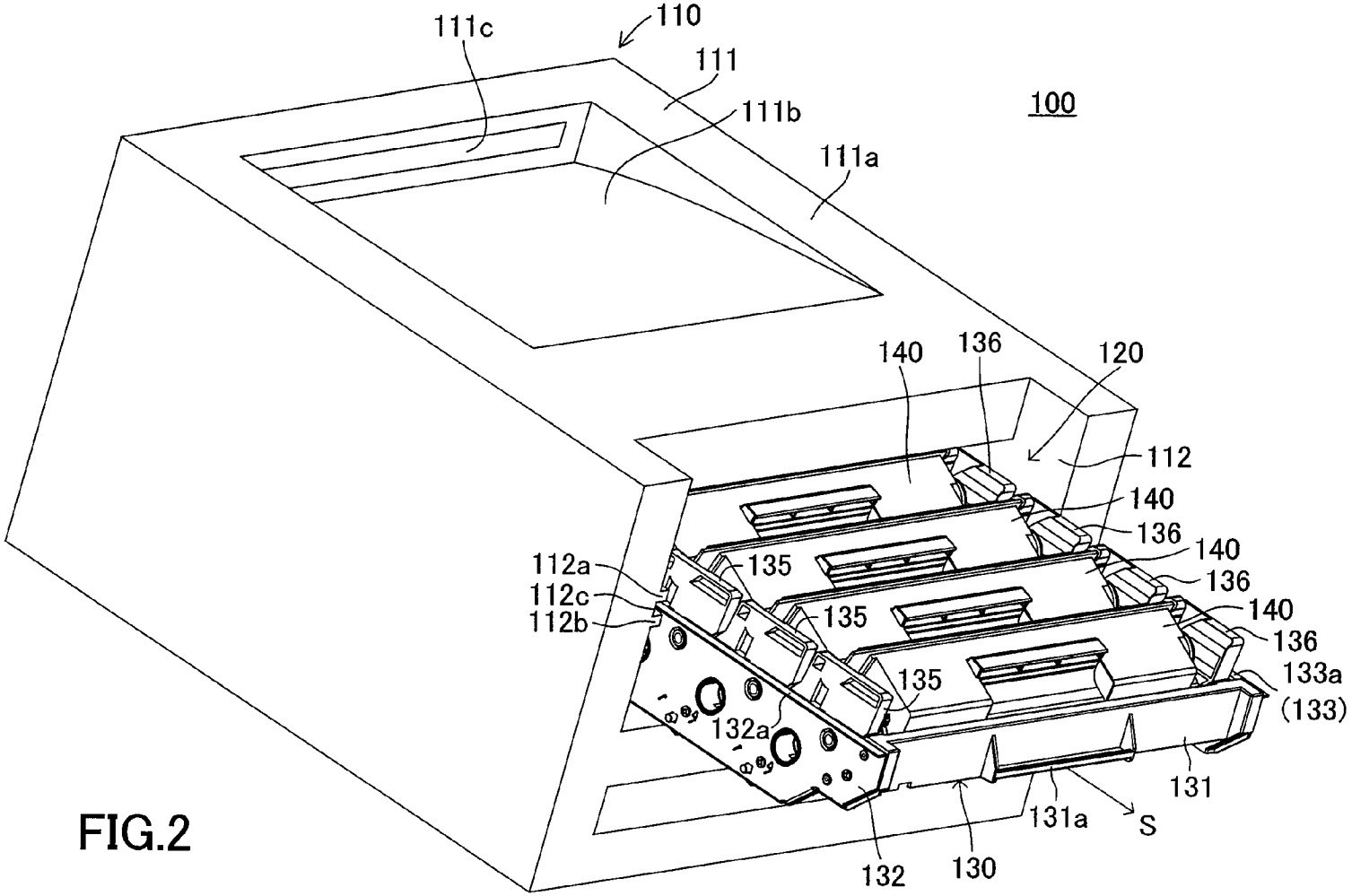
FIG. 2 is a perspective view of the color image forming unit when the color image forming unit shown in FIG. 1 is pulled out towards the front side.
Figure 3:
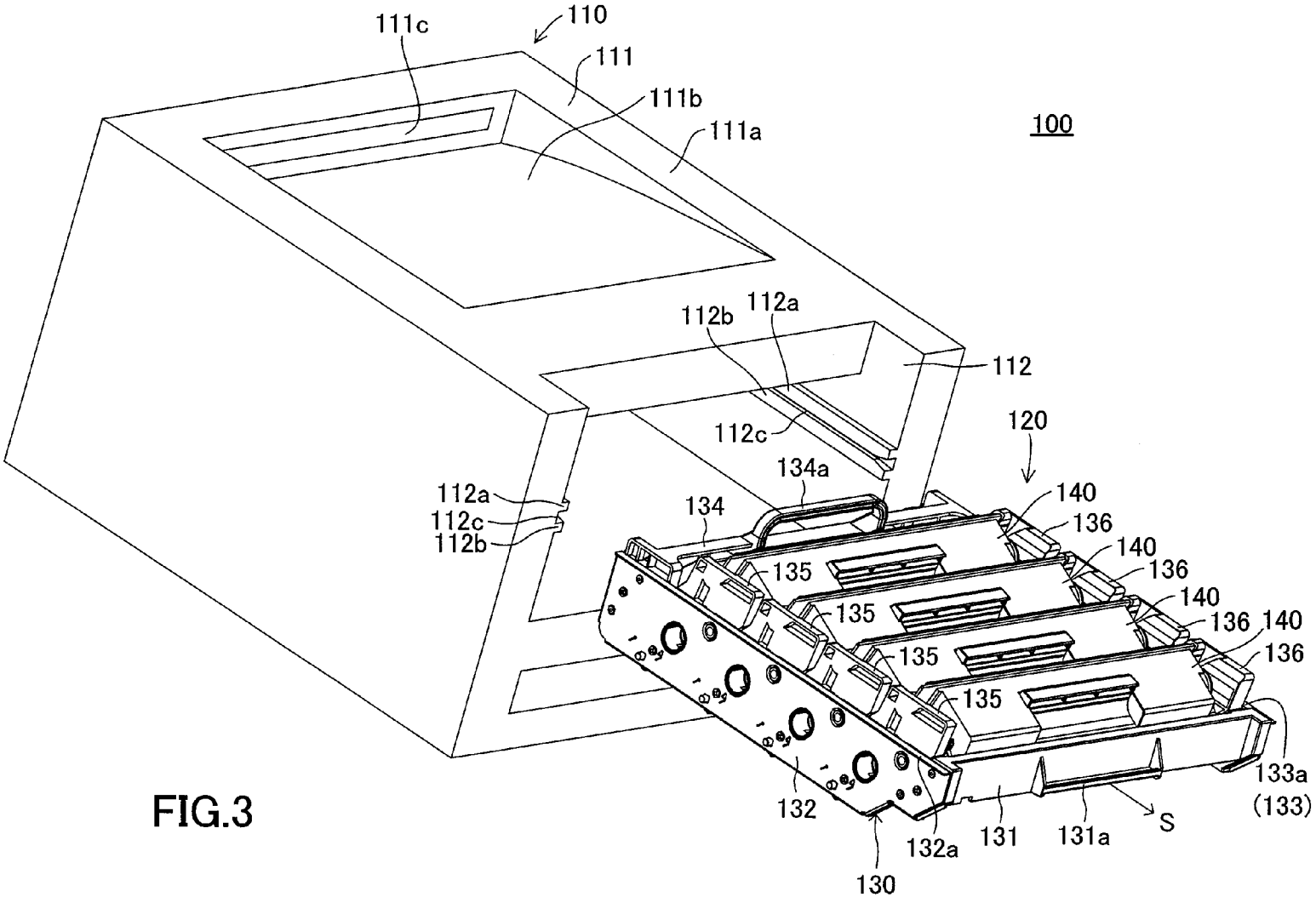
FIG. 3 is a perspective view of the color image forming unit when the color image forming unit shown in FIG. 1 is further pulled out towards the front side and is removed to outside a body of the color laser printer.

In the color laser printer 100 according to the present embodiment, when the front cover 111*e* is open towards the front side and the front-side grip 131*a* is pulled out in the sliding direction (the direction indicated by arrow S), as shown in FIG. 1, the color image forming unit 120 is pulled out towards the front side, as shown in FIGS. 2 and 3.

FIG. 2 is a perspective view of the color image forming unit 120 when the color image forming unit 120 shown in FIG. 1 is pulled out towards the front side. FIG. 3 is a perspective view of the color image forming unit 120 when the color image forming unit 120 is further pulled out and is removed from the body section 110.

As shown in FIG. 2, two supporting plates 132 and 133 are connected to either end of the front beam 131. The supporting plates 132 and 133 are disposed so as to be perpendicular to a horizontal plane and so as to be parallel to the sliding direction. A flange 132*a* is formed on the upper end of the supporting plate 132. The flange 132*a* extends outwardly so as to be accommodated in the image-forming-unit removal guide groove 112*c* formed on the body frame 112. Similarly, a flange 133*a* is formed on the upper end of the supporting plate 133.

Thus, according to the present embodiment, for the body frame 112 and the slide frame 130, the flanges 132*a* and 133*a* are guided by the image-forming-unit removal guide groove 112*c* so that the color image forming unit 120 can be pulled out in the sliding direction.

As shown in FIG. 3, the slide frame 130 is removable from the body frame 112. That is, the slide frame 130 can be completely separated from the body section 110 so that the color image forming unit 120 is interchangeable.

The slide frame 130 includes the front beam 131, the supporting plate 132, the supporting plate 133, a rear beam 134, and side plates 135, and side plates 136.

The front end of either one of the supporting plates 132 and 133 is connected to the front beam 131. The rear end of either one of the supporting plates 132 and 133 is connected to the rear beam 134. These front beam 131, the supporting plate 132, the supporting plate 133, and the rear beam 134 forms a rectangular frame in plan view, which serves as a main frame of the slide frame 130. Inside the rectangular frame, the four image forming cartridges 140 are aligned along the sliding direction.

An inverted U-shaped back-side grip 134*a* is formed on the upper end of the rear beam 134. The front-side grip 131*a* and the back-side grip 134*a* are formed so that the color image forming unit 120 (the slide frame 130) can be easily carried by holding the back-side grip 134*a* and the front-side grip 131*a*.

A pair of the side plates 135 and 136 supports the image forming cartridge 140 in the slide frame 130. According to the present embodiment, four pairs of side plates 135 and 136 are provided so as to correspond to the four image forming cartridges 140. Four pairs of the side plates 135 and 136 are aligned along the sliding direction. The four side plates 135 are supported by the supporting plate 132 disposed outside the side plates 135. Similarly, the four side plates 136 are supported by the supporting plate 133 disposed outside the side plates 136.

Outline of Internal Structure of Color Laser Printer

Figure 4:
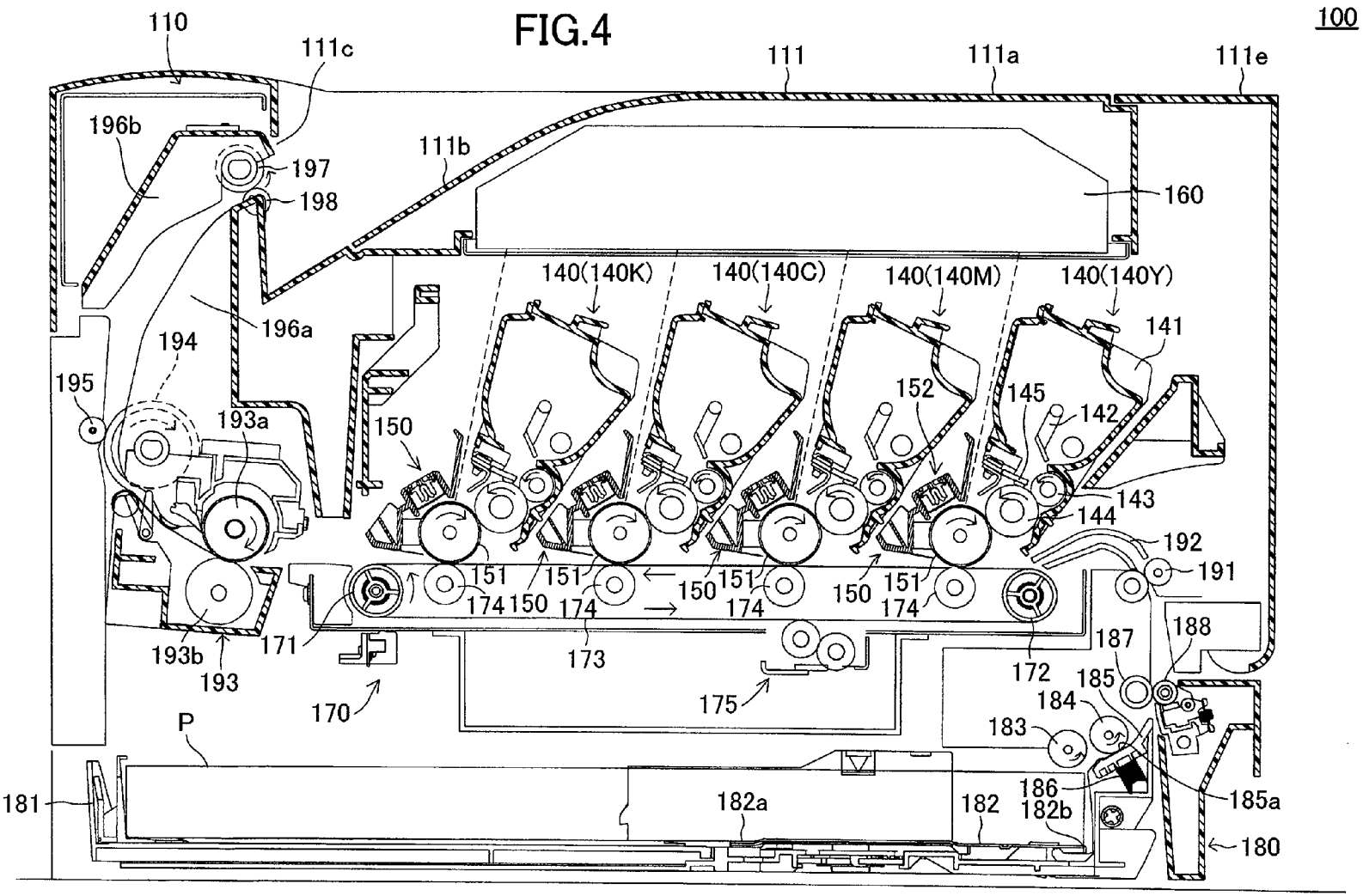
FIG. 4 is a side cross-sectional view of the color laser printer shown in FIG. 1.

FIG. 4 is a side cross-sectional view of the color laser printer 100 shown in FIG. 1.

As noted above, in the body section 110 of the color laser printer 100, a plurality of the image forming cartridges 140 are arranged. A plurality of drum units 150 are arranged so as to face the plurality of the image forming cartridges 140, respectively. A scanner unit 160 is disposed above the image forming cartridges 140 and the drum units 150. A transfer unit 170 is disposed under the image forming cartridges 140 and the drum units 150. A feeder unit 180 is disposed under the transfer unit 170.

Outline of Structure of Image Forming Cartridge

The image forming cartridges 140 contain black toner (developer material), cyan toner, magenta toner, and yellow toner, respectively. That is, a black image forming cartridge 140K contains black toner. A cyan image forming cartridge 140C contains cyan toner. A magenta image forming cartridge 140M contains magenta toner. A yellow image forming cartridge 140Y contains yellow toner. The black image forming cartridge 140K, the cyan image forming cartridge 140C, the magenta image forming cartridge 140M, and the yellow image forming cartridge 140Y have the same structure.

Each of the image forming cartridges 140 includes a cartridge case 141, an agitator 142, a supply roller 143, a development roller 144, and a blade 145.

The cartridge case 141 can support the agitator 142, the supply roller 143, the development roller 144, and the blade 145, and can also contain toner, which serves as a developer material for developing an electrostatic latent image.

The agitator 142 agitates the toner particles contained in the cartridge case 141. The agitator 142 is rotatably supported by the cartridge case 141.

The supply roller 143 is formed from a sponge roller. The supply roller 143 is rotatably supported by the cartridge case 141. The development roller 144 is formed from a rubber roller. The development roller 144 is also rotatably supported by the cartridge case 141. The supply roller 143 and the development roller 144 are disposed in parallel so as to be in contact with each other.

The supply roller 143 is rotatably driven in a direction shown by an arrow of FIG. 4 so as to supply the periphery of the development roller 144 with charged toner particles. The blade 145 is in contact with the peripheral surface of the development roller 144, which is rotatably driven in the direction shown by an arrow of FIG. 4, in the counter direction so as to control the amount of toner particles deposited on the peripheral surface.

The structure of the image forming cartridge 140 will be described in more detail later.

Outline of Structure of Drum Unit

Each of the drum units 150 includes a photoconductive drum 151 and a scorotron charger 152.

The photoconductive drum 151 allows an electrostatic latent image to be formed on the peripheral surface thereof. The photoconductive drum 151 is disposed so as to face the development roller 144 of the image forming cartridge 140. The scorotron charger 152 uniformly charges the peripheral surface of the photoconductive drum 151. The structure of the drum unit 150 will be described in more detail later.

In the scanner unit 160, a laser beam generated by a laser emitting unit (not shown) on the basis of image data scans the peripheral surface of the photoconductive drum 151 in the width direction (a direction that is perpendicular to the plane of FIG. 4).

Structure of Transfer Unit

The transfer unit 170 includes a belt driving roller 171, a driven roller 172, a transport belt 173, a transfer roller 174, and a belt cleaner 175.

The belt driving roller 171 is disposed closer to the back side than the drum unit 150 that faces the black image forming cartridge 140K located at the closest position to the back side among the plurality of image forming cartridges 140. The driven roller 172 is disposed closer to the front side than the drum unit 150 that faces the yellow image forming cartridge 140Y located at the closest position to the front side among the plurality of image forming cartridges 140. The belt driving roller 171 and the driven roller 172 are rotatably supported by the body section 110.

The transport belt 173 is in the form of a continuous belt. The transport belt 173 is formed from a conductive resin film such as a conductive polycarbonate or polyimide film in which conductive particles (such as carbon particles) are dispersed. The transport belt 173 is entrained about the belt driving roller 171 and the driven roller 172. When the belt driving roller 171 rotates in the direction shown by an arrow in FIG. 4, the transport belt 173 moves in the direction shown by an arrow in FIG. 4. That is, when the transport belt 173 moves in the direction shown by an arrow in FIG. 4, a paper sheet P held on the transport belt 173 can be transported in the direction in which the image forming cartridges 140 are aligned.

The transfer roller 174 is disposed beneath the photoconductive drum 151 so as to face the photoconductive drum 151 with the transport belt 173 therebetween. The transfer roller 174 is rotatably supported. The transfer roller 174 can rotate in synchronization with the movement of the transport belt 173 in a direction indicated by arrows of FIG. 4. A high-voltage power supply for outputting a transfer bias voltage is electrically connected to the transfer roller 174 so that the toner particles on the photoconductive drum 151 are transferred towards the transport belt 173 (onto the paper sheet P).

The belt cleaner 175 is disposed beneath the transport belt 173 that is entrained under the transfer rollers 174. The belt cleaner 175 is configured to clean the surface areas of the transport belt 173 which have faced the image forming cartridges 140 and the drum units 150.

Structure of Feeder Unit

A feeder case 181 defines a casing of the feeder unit 180. The feeder case 181 can store a plurality of the stacked paper sheets P. A sheet pressure plate 182 is disposed in the feeder case 181. A rear end 182*a* of the sheet pressure plate 182, which is located at the back side (the left-hand side in FIG. 4), is rotatably supported by the feeder case 181. That is, the sheet pressure plate 182 is pivotably supported by the feeder case 181 so that a front end 182*b* of the sheet pressure plate 182, which is located at the front side (the right-hand side in FIG. 4), can substantially vertically move.

A feed roller 183 is disposed above the front end 182*b* of the sheet pressure plate 182. The feed roller 183 is formed from synthetic rubber. The feed roller 183 is supported by the body section 110 so as to be rotatably driven in the direction indicated by an arrow of FIG. 4. When the feed roller 183 is rotatably driven in the direction indicated by the arrow of FIG. 4, the feed roller 183 can feed the paper sheet P stored in the feeder case 181 towards the front side (the right-hand side in FIG. 4).

In the direction in which the paper sheet P is fed by the feed roller 183 (the front side, i.e., the right-hand side in FIG. 4), a separation roller 184 is disposed. The separation roller 184 is formed from synthetic rubber. The separation roller 184 is supported by the body section 110 so as to be rotatably driven in the direction indicated by an arrow of FIG. 4.

A separation pad 185 is disposed so as to face the separation roller 184. The separation pad 185 has a separation surface 185*a* that faces the separation roller 184. The separation surface 185*a* is formed from a material having a high coefficient of friction (such as synthetic rubber or felt). A separation pad biasing spring 186 is disposed beneath the separation pad 185. The separation pad biasing spring 186 presses the separation pad 185 against the separation roller 184 so that the separation roller 184 and the separation pad 185 press each other.

When the separation roller 184 is rotatably driven in the direction indicated by an arrow of FIG. 4, the separation roller 184, the separation pad 185, and the separation pad biasing spring 186 separate the paper sheets P one by one and deliver the paper sheet P into a nip formed by a paper-dust removal roller 187 and a pinch roller 188.

The paper-dust removal roller 187 removes paper dusts deposited on the paper sheet P. The paper-dust removal roller 187 is disposed so as to face the pinch roller 188. The paper-dust removal roller 187 is also disposed so as to be parallel to the pinch roller 188 along the direction in which the paper sheet P is fed by the separation roller 184.

Structure of Sheet Transport and Fixing System

In the transfer unit 170, at a position closer to the front side than the driven roller 172, a sheet transport roller 191 and a sheet guide 192 are disposed. The sheet transport roller 191 and the sheet guide 192 are configured to transport the paper sheet P fed from the feeder unit 180 onto the transport belt 173 disposed on the peripheral surface of the driven roller 172.

In the transfer unit 170, a fixing unit 193 is disposed at a position that is closer to the back side than the belt driving roller 171 and that is the destination of the paper sheet P delivered by the belt driving roller 171 and the transport belt 173.

The fixing unit 193 includes a heat roller 193*a* and a pressure roller 193*b*. The heat roller 193*a* includes a metallic cylinder with the surface subjected to a mold release treatment. The metallic cylinder accommodates a halogen lamp. The heat roller 193*a* is rotatably supported so as to be driven in a direction indicated by an arrow in FIG. 4 (in the clockwise direction). The pressure roller 193*b* is formed from a silicon rubber. The pressure roller 193*b* is disposed so as to press against the heat roller 193*a* at a predetermined pressure. The pressure roller 193*b* is rotatably supported so that the rotation of the pressure roller 193*b* follows the rotation of the heat roller 193*a*. Thus, the pressure roller 193*b* rotates in the counterclockwise direction in FIG. 4. In the fixing unit 193, when the heat roller 193*a* is rotatably driven in a direction indicated by an arrow of FIG. 4, the toner particles deposited on the paper sheet P are fused (fixed) to the paper sheet P while the paper sheet P is transported towards the paper ejection port 111*c*.

The paper sheet P is transported by the heat roller 193*a* and the pressure roller 193*b* to a fused sheet transport roller 194 and a pinch roller 195. The fused sheet transport roller 194 is rotatably supported so as to be driven in a direction indicated by an arrow of FIG. 4. The pinch roller 195 is disposed so as to face the fused sheet transport roller 194. The pinch roller 195 is rotatably supported so that the rotation of the pinch roller 195 follows the rotation of the fused sheet transport roller 194 indicated by an arrow of FIG. 4. Thus, when the fused sheet transport roller 194 and the pinch roller 195 rotate in the directions indicated by the arrow of FIG. 4 for the fused sheet transport roller 194, the fused sheet transport roller 194 and the pinch roller 195 can transport the fused paper sheet P towards the paper ejection port 111*c*.

The fused sheet transport roller 194 and the pinch roller 195 transport the fused paper sheet P to fused sheet guides 196*a* and 196*b*. The fused sheet guides 196*a* and 196*b* can guide the fused paper sheet P transported by the fused sheet transport roller 194 and the pinch roller 195 to a contact point between a paper ejection roller 197 and a paper ejection driven roller 198.

The paper ejection roller 197 and the paper ejection driven roller 198 are disposed in the vicinity of the paper ejection port 111*c* so as to face the paper ejection port 111*c*. The paper ejection roller 197 is rotatably disposed so as to be driven in a direction indicated by an arrow of FIG. 4. The paper ejection driven roller 198 is disposed so as to face the paper ejection roller 197. The paper ejection driven roller 198 is rotatably supported so that the rotation of the paper ejection driven roller 198 follows the rotation of the paper ejection roller 197 indicated by an arrow of FIG. 4. Thus, when the paper ejection roller 197 and the paper ejection driven roller 198 rotate in the directions indicated by the arrow of FIG. 4 for the paper ejection roller 197, the paper ejection roller 197 and the paper ejection driven roller 198 can eject the fused paper sheet P to outside the body section 110.

Detailed Internal Structure of Image Forming Cartridge

Figure 5:
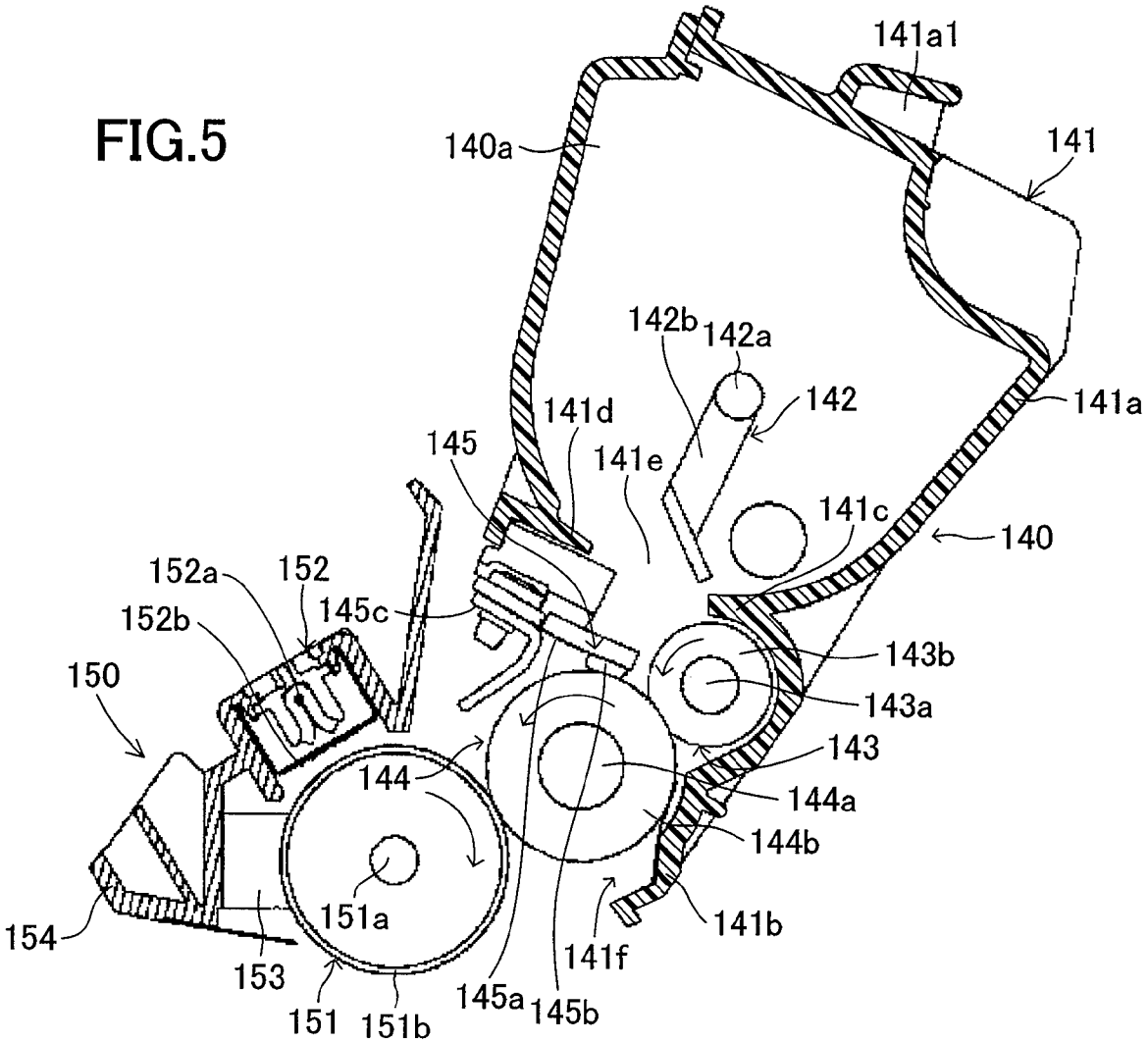
FIG. 5 is a side cross-sectional view of the image forming cartridge and a drum unit shown in FIG. 4.

FIG. 5 is a side cross-sectional view of the image forming cartridge 140 and the drum unit 150 shown in FIG. 4.

As shown in FIG. 5, the cartridge case 141 includes a toner container case 141*a* that forms a toner container 140*a* for storing toner particles and a roller supporter 141*b* for rotatably supporting a supply roller 143 and a development roller 144.

A cartridge grip 141*a*1 is formed on the top surface of the toner container case 141*a*.

The cartridge grip 141*a*1 is used to mount or dismount the image forming cartridge 140. Partition walls 141*c* and 141*d* are formed in the interface between the toner container case 141*a* and the roller supporter 141*b*. A toner passage opening 141*e* for allowing the toner particles to pass therethrough is formed between the partition walls 141*c* and 141*d*.

The agitator 142 is rotatably disposed in the toner container 140*a* of the toner container case 141*a*. The agitator 142 includes a metallic agitator rotation center shaft 142*a* and an agitating member 142*b* secured to the agitator rotation center shaft 142*a*. When the agitator 142 is rotatably driven, the agitator 142 agitates the toner particles contained in the toner container 140*a* and delivers the toner particles to the toner passage opening 141*e*.

The supply roller 143 is rotatably supported in the roller supporter 141*b* and in the vicinity of the toner passage opening 141*e*. The supply roller 143 is disposed between the development roller 144 and the toner passage opening 141*e*. The supply roller 143 includes a metallic supply-roller rotation center shaft 143*a* and a sponge layer 143*b* formed around the supply-roller rotation center shaft 143*a*. When the supply roller 143 is rotatably driven in a direction indicated by an arrow of FIG. 5, the supply roller 143 can supply the toner particles delivered through the toner passage opening 141*e* to a contact point between the supply roller 143 and the development roller 144.

A development-roller exposure opening 141*f* is formed on an end of the cartridge case 141 adjacent to the roller supporter 141*b*. The development-roller exposure opening 141*f* is formed so that the peripheral surface of the development roller 144 can be exposed to outside the cartridge case 141 (to the peripheral surface of the photoconductive drum 151).

The development roller 144 includes a metallic development-roller rotation center shaft 144*a* and a semiconductive rubber layer 144*b* formed around the development-roller rotation center shaft 144*a*. The semiconductive rubber layer 144*b* is formed by mixing carbon black with synthetic rubber. That is, the development roller 144 is formed so that a developing bias voltage can be applied to the interface between the peripheral surface of the development roller 144 and the photoconductive drum 151.

The development roller 144 is disposed so as to press against the sponge layer 143*b* of the supply roller 143 at a predetermined pressure. Thus, the sponge layer 143*b* deforms when pressed by the development roller 144. Additionally, when the development roller 144 and the supply roller 143 are rotatably driven in the directions indicated by the arrows of FIG. 5, toner particles are tribocharged at the interface between the supply roller 143 and the development roller 144. The charged toner particles are supplied to the peripheral surface of the development roller 144.

The blade 145 includes a blade body 145*a* and a blade tip 145*b*. The blade body 145*a* is formed from a flexible metallic plate. The blade tip 145*b* is formed from synthetic rubber. The blade tip 145*b* is secured at the top end of the blade body 145*a*. The base end of the blade body 145*a* (an end remote from the end at which the blade tip 145*b* is secured) is pressed by a blade presser 145*c* formed from a metallic plate and is secured to the cartridge case 141 by means of, for example, a screw. At that time, the blade 145 is disposed so that, since the blade body 145*a* resiliently deforms, the blade tip 145*b* is pressed against the peripheral surface of the development roller 144 at a predetermined pressure. Since the blade tip 145*b* is pressed against the peripheral surface of the development roller 144 at a predetermined pressure, the blade 145 can control the amount of toner particles deposited on the peripheral surface of the development roller 144 and the amount of charge retained on the peripheral surface of the development roller 144.

Detailed Structure of Drum Unit

As shown in FIG. 5, the drum unit 150 includes the photoconductive drum 151, the scorotron charger 152, a drum cleaner 153, and a drum unit frame 154.

The photoconductive drum 151 includes a metallic photoconductive-drum rotation center shaft 151*a* and a sleeve-shaped drum body 151*b* formed around the metallic photoconductive-drum rotation center shaft 151*a*. The drum body 151*b* includes a metallic sleeve and a photoconductive layer (a photoconductive resin layer) formed on the outer surface of the sleeve. The photoconductive-drum rotation center shaft 151*a* is coupled with an end of the drum body 151*b*. Also, the photoconductive-drum rotation center shaft 151*a* is electrically connected to the drum body 151*b*.

The scorotron charger 152 is disposed upstream of a position at which the photoconductive drum 151 faces the development roller 144 (a position at which the photoconductive drum 151 is the closest to the development roller 144) in the rotational direction of the photoconductive drum 151 (the direction indicated by an arrow of FIG. 5). The scorotron charger 152 is located so as to face the peripheral surface of the photoconductive drum 151 with a predetermined spacing therebetween.

The scorotron charger 152 includes a discharge wire 152*a* and a grid 152*b*. The discharge wire 152*a* and the grid 152*b* are electrically connected to a high-voltage power supply for outputting a predetermined high voltage.

The drum cleaner 153 for cleaning the peripheral surface of the photoconductive drum 151 is disposed upstream of a position at which the photoconductive drum 151 faces the scorotron charger 152 (a position at which the photoconductive drum 151 is the closest to the scorotron charger 152) in the rotational direction of the photoconductive drum 151 (the direction indicated by the arrow of FIG. 5). The drum cleaner 153 includes a brush formed from a conductive synthetic resin. By applying a predetermined cleaning bias voltage to the interface between the brush and the peripheral surface of the photoconductive drum 151, the drum cleaner 153 can electrostatically attract dusts and toner particles remaining on the peripheral surface of the photoconductive drum 151. The drum cleaner 153 is also connected to the high-voltage power supply for outputting a predetermined high voltage.

The photoconductive drum 151 is rotatably supported by the drum unit frame 154. The drum unit frame 154 is formed from a synthetic resin. Additionally, the scorotron charger 152 and the drum cleaner 153 are supported by the drum unit frame 154 at predetermined positions.

Detailed External Structure of Image Forming Cartridge

Figure 6:
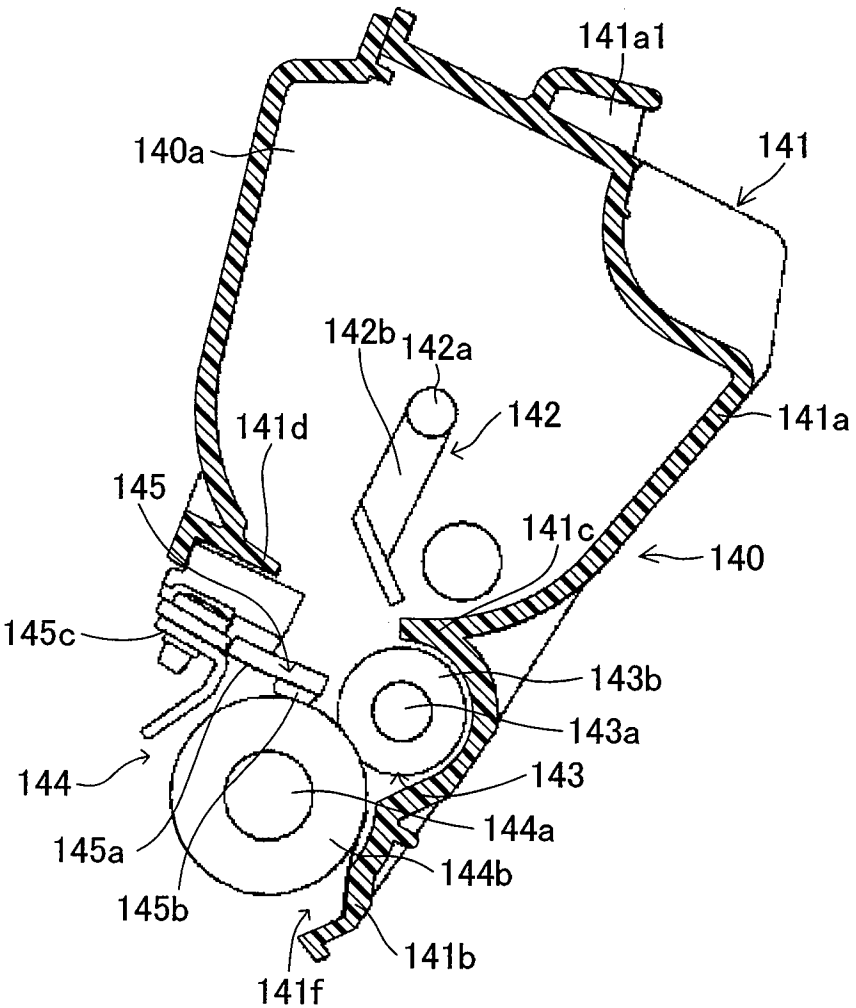
FIG. 6 is a side cross-sectional view of the image forming cartridge shown in FIG. 4.
Figure 7:
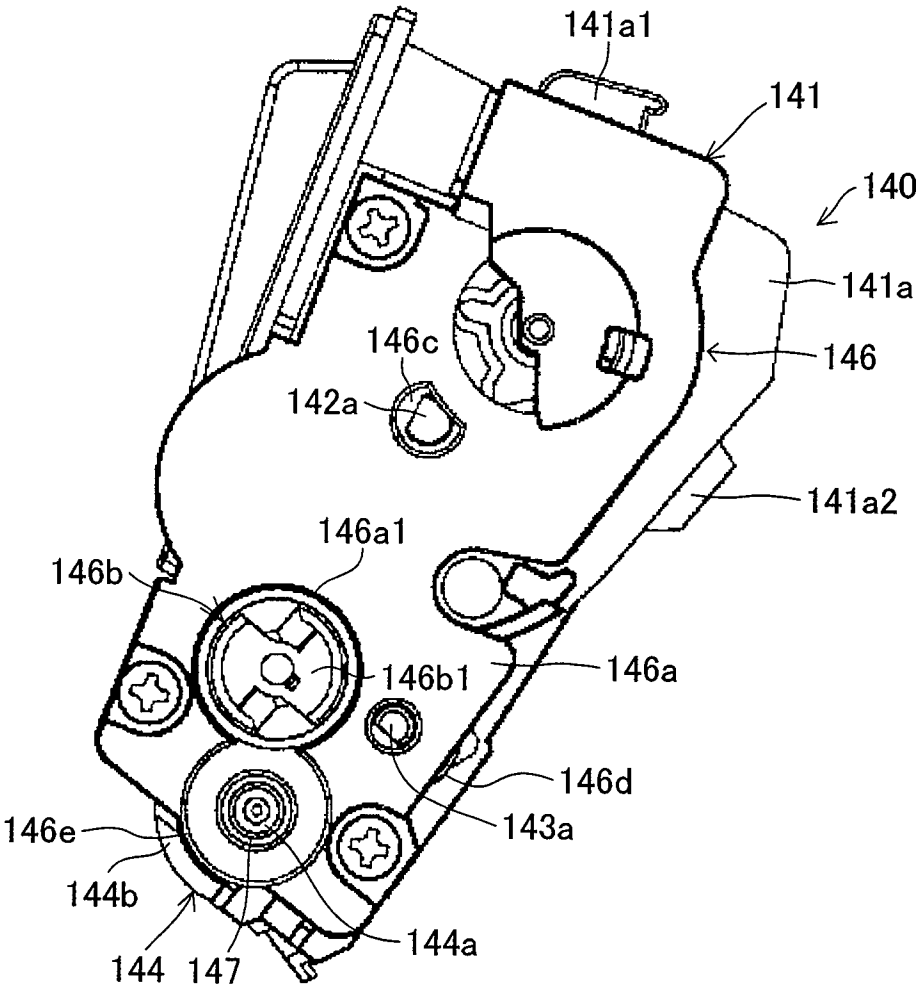
FIG. 7 is a side elevational view of the image forming cartridge shown in FIG. 4.
Figure 8:
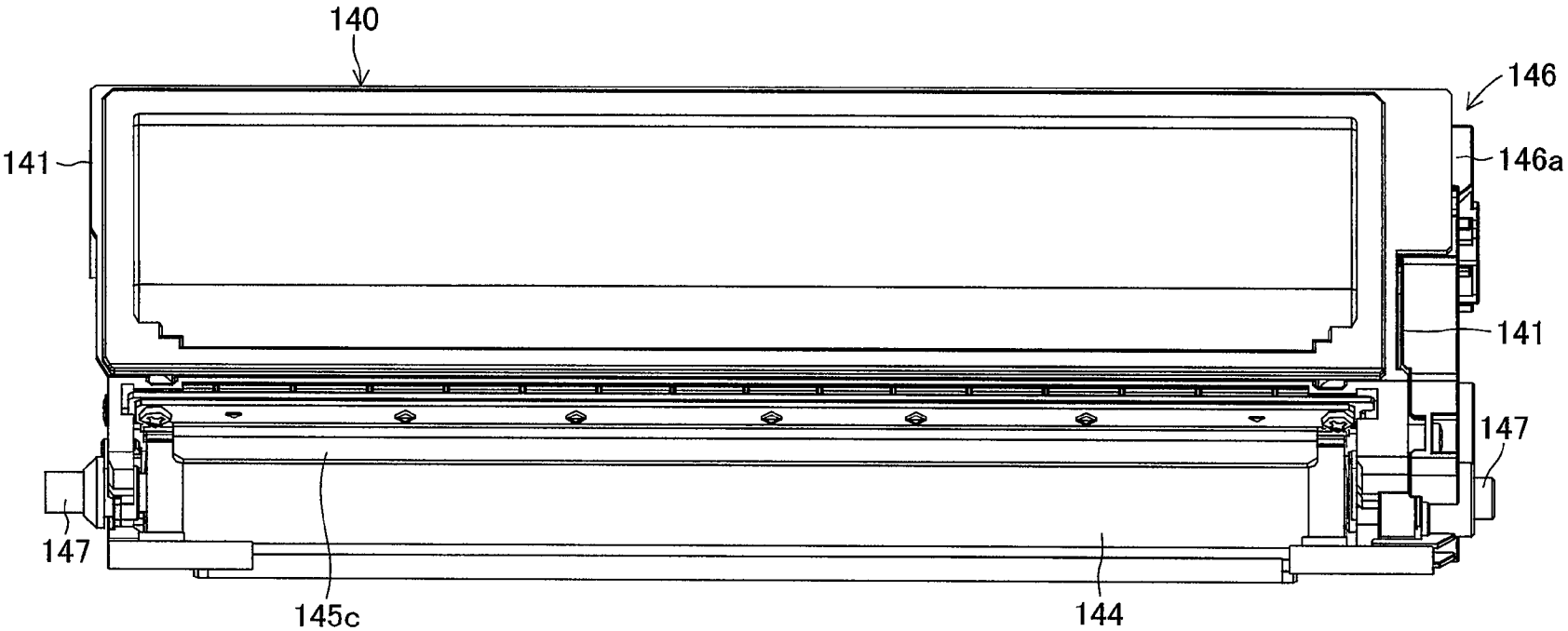
FIG. 8 is a plan view of the image forming cartridge shown in FIG. 4.

FIG. 6 is a side cross-sectional view of the image forming cartridge 140 shown in FIG. 4. That is, FIG. 6 is a side cross-sectional view of the image forming cartridge 140 when the drum unit 150 is removed from the view of FIG. 5. FIG. 7 is a side elevational view illustrating the appearance of the image forming cartridge 140. That is, FIG. 7 is a side elevational view corresponding to the center section of FIG. 6. FIG. 8 is a plan view of the image forming cartridge 140.

As shown in FIG. 7, a leg 141*a*2 is formed so as to protrude from the bottom of the toner container case 141*a* (on the right-hand side in FIG. 7) of the cartridge case 141. The leg 141*a*2 is designed so that, when the image forming cartridge 140 is placed on a workbench or a table, the leg 141*a*2 is in contact with the top surface of the workbench or the table.

As shown in FIGS. 7 and 8, a gear train 146 is disposed on an end of the cartridge case 141 in the width direction of the cartridge case 141 (in a horizontal direction in FIG. 8). The gear train 146 is configured to transfer a rotational driving force to components of a rotational driving system provided to the image forming cartridge 140 (i.e., the agitator 142, the supply roller 143, and the development roller 144 shown in FIG. 6).

The structure of the gear train 146 is described in more detail next. A gear cover 146*a* is provided so as to cover an end of the cartridge case 141 in the width direction. As shown in FIG. 7, gears including a coupling gear 146*b*, an agitator driving gear 146*c*, a supply roller driving gear 146*d*, and a development roller driving gear 146*e* are disposed in the interior of the gear cover 146*a*, that is, in the space between the side wall of the cartridge case 141 and the gear cover 146*a*. Each of these gears is rotatably supported by the side wall of the cartridge case 141 and the gear cover 146*a*.

As shown in FIG. 7, a coupling recess 146*b*1 is formed on the coupling gear 146*b*. The coupling recess 146*b*1 is exposed to outside the gear cover 146*a* through an opening 146*a*1, which is a through-hole formed in the gear cover 146*a*. The coupling recess 146*b*1 has a shape so as to engage with a coupling input shaft (not shown) (a coupling input shaft 112*d* shown in FIG. 9) provided outside the image forming cartridge 140 (the body frame 112 shown in FIG. 1). That is, since the coupling input shaft having a rotational driving force from the driving source provided outside (the body frame 112 shown in FIG. 11) engages with the coupling recess 146*b*1, the rotational driving force from the driving source can be transferred to the coupling gear 146*b* via the coupling input shaft.

The agitator driving gear 146*c* is mounted on an end of the agitator rotation center shaft 142*a*. The agitator driving gear 146*c* is engaged with the coupling gear 146*b* via an intermediate gear (not shown).

The supply roller driving gear 146*d* is coupled with an end of the supply-roller rotation center shaft 143*a*. The supply roller driving gear 146*d* is directly engaged with the coupling gear 146*b*.

The development roller driving gear 146*e* is coupled with an end of the development-roller rotation center shaft 144*a*. The development roller driving gear 146*e* is directly engaged with the coupling gear 146*b*.

A collar member 147 is provided so as to cover an end of the development-roller rotation center shaft 144*a*. The collar member 147 is formed from a conductive synthetic resin (e.g., a synthetic resin mixed with carbon black). The collar member 147 is in contact with the development-roller rotation center shaft 144*a*, and therefore, the collar member 147 is electrically connected to the development-roller rotation center shaft 144*a* (the development roller 144). As shown in FIG. 8, the collar member 147 is provided so as to correspond to either end of the development roller 144 (the development-roller rotation center shaft 144*a* shown in FIGS. 6 and 7).

Detailed Structure of Sliding Frame

Figure 9:
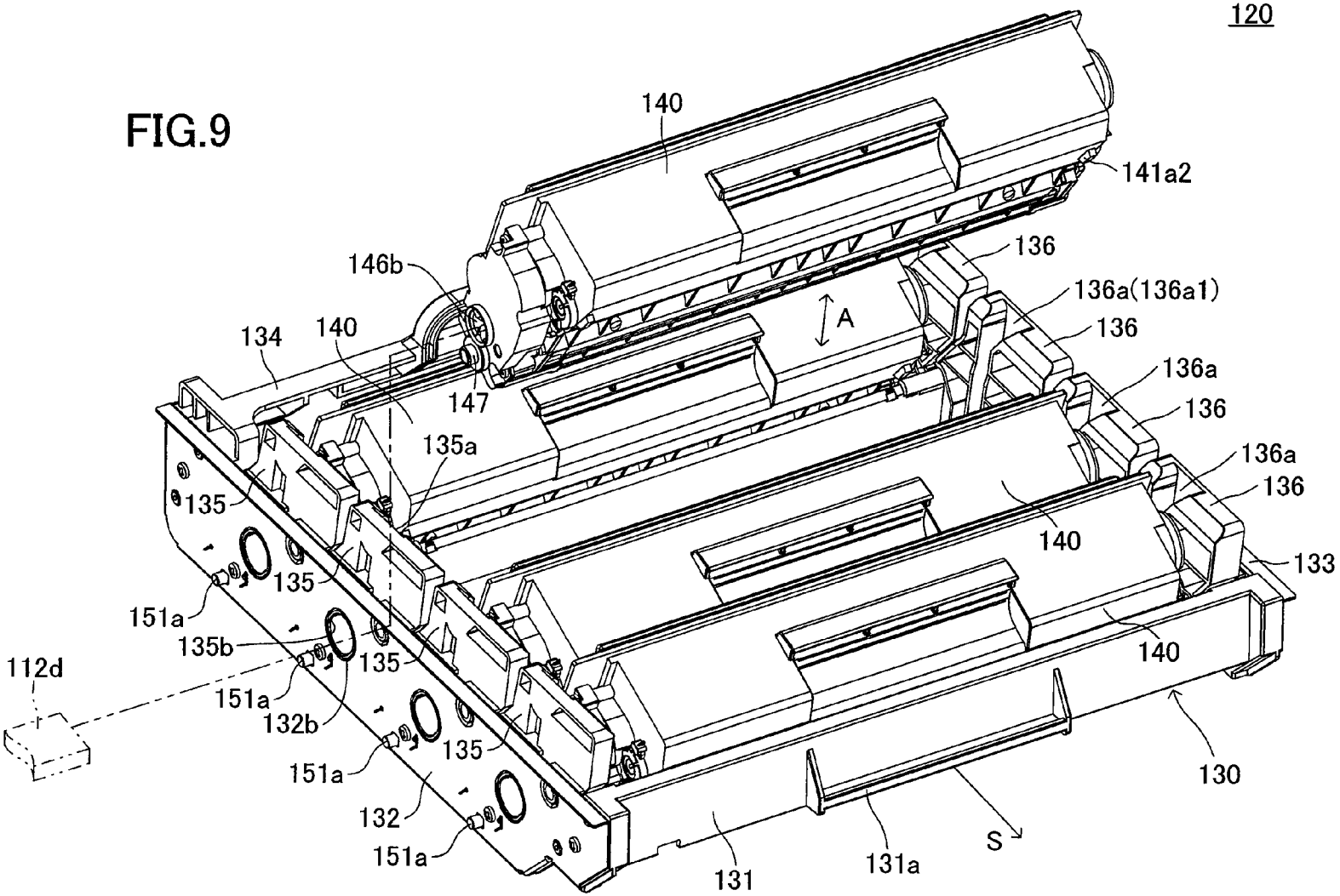
FIG. 9 is a perspective view, viewed from above at an oblique angle (the same direction as that of FIG. 3), of the color image forming unit shown in FIGS. 1 to 3.
Figure 10:
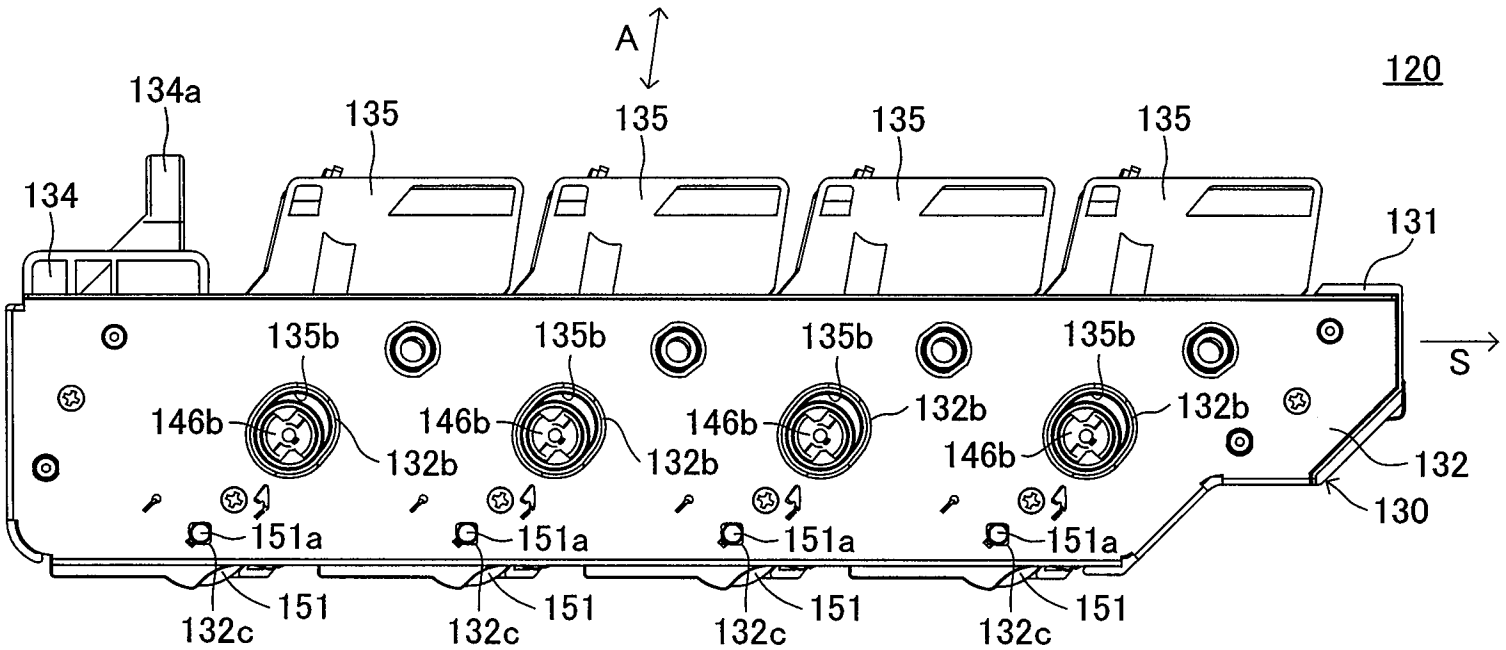
FIG. 10 is a side elevational view of the color image forming unit shown in FIG. 9.
Figure 11:
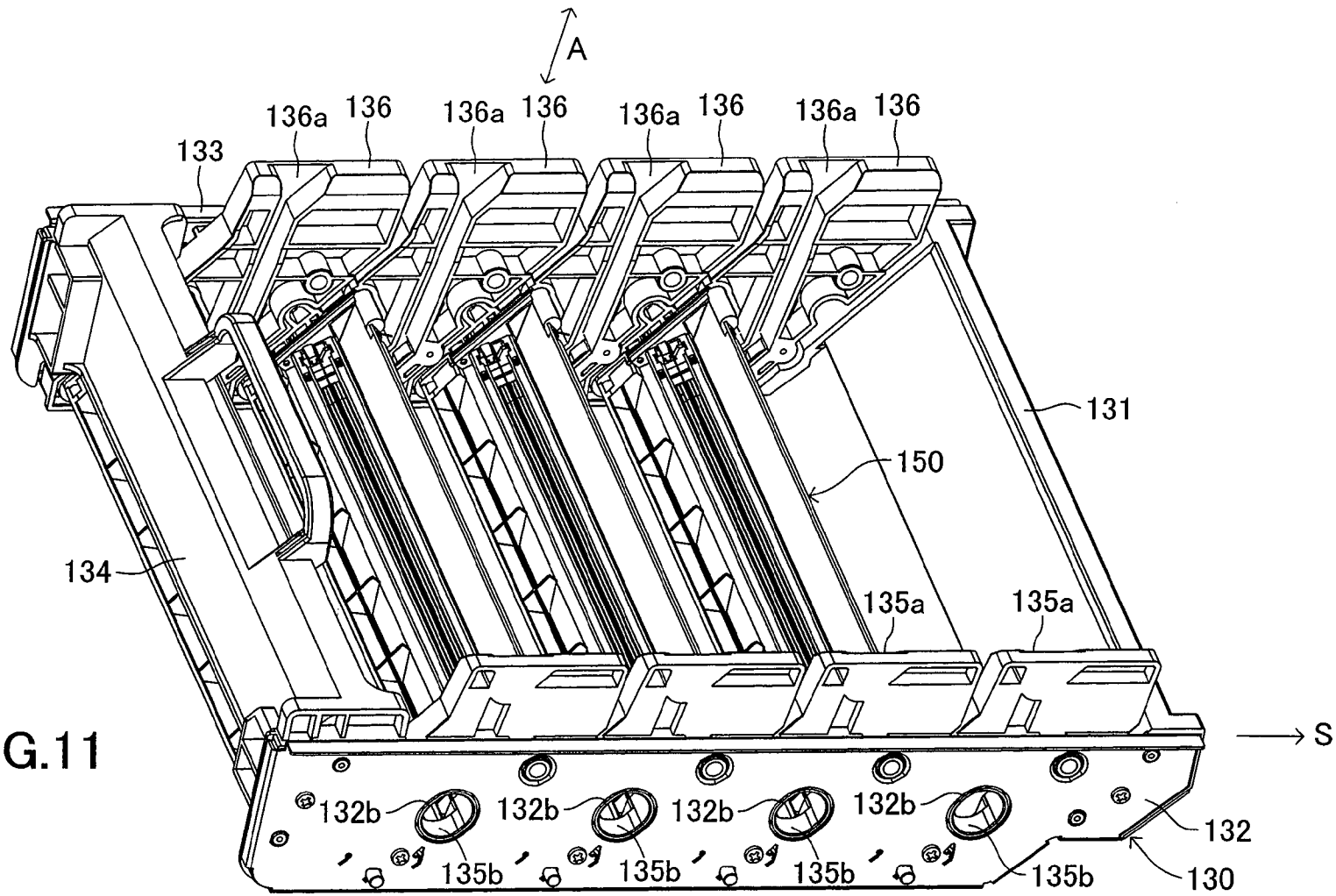
FIG. 11 is a perspective view, viewed from above at an oblique angle, of a slide frame shown in FIG. 9 when all the image forming cartridges are removed.

FIG. 9 is a perspective view, viewed from above at an oblique angle (the same direction as that of FIG. 3), of the color image forming unit 120 shown in FIGS. 1 to 3. FIG. 10 is a side elevational view of the color image forming unit 120 shown in FIG. 9. FIG. 11 is a perspective view, viewed from above at an oblique angle, of the slide frame 130 shown in FIG. 9 when all the image forming cartridges 140 are removed.

As shown in FIG. 9, the front beam 131, the supporting plate 132, the supporting plates 132 and 133, and the rear beam 134 of the slide frame 130 form a space. In this space, the image forming cartridges 140 are aligned along the sliding direction (the direction indicated by arrow S of FIG. 9). The slide frame 130 is configured so that the image forming cartridge 140 can be removed in a predetermined direction of insertion of the cartridge that crosses the sliding direction. That is, the image forming cartridge 140 is inserted into the slide frame 130 along the direction of insertion of the cartridge (the direction indicated by arrow A of FIG. 9: the second direction in the present invention) so as to be mounted on the slide frame 130 via the side plates 135 and 136.

As noted above, a plurality of the side plates 135 and 136 are aligned along the sliding direction (the direction indicated by arrow S of FIG. 9). These side plates 135 and 136 are arranged in parallel to the sliding direction and the direction of insertion of the cartridge (the direction indicated by arrow A of FIG. 9). These side plates 135 and 136 are configured so as to guide the image forming cartridges 140 along the direction of insertion of the cartridge when the image forming cartridges 140 are mounted in or dismounted from the slide frame 130.

The structure of each component of the slide frame 130 is described in detail below with reference to the accompanying drawings.

Structure of Supporting Plate on One Side

As shown in FIGS. 9 and 10, the supporting plate 132 is attached to the side plates 135 by means of screws in order to support the side plates 135. The supporting plate 132 is disposed in parallel to the side plates 135.

A plurality of coupling through-holes 132*b* is formed in the supporting plate 132. The coupling gear 146*b* is exposed through a corresponding one of the coupling through-holes 132*b* so as to be engaged with the coupling input shaft 112*d*. The coupling through-holes 132*b* are aligned along the sliding direction (the direction indicated by arrow S of FIG. 9) so as to correspond to the arrangement of the image forming cartridges 140.

A conductive-drum shaft supporting hole 132*c* is formed diagonally below each of the coupling through-holes 132*b*. The photoconductive-drum rotation center shaft 151*a* is inserted into the conductive-drum shaft supporting hole 132*c*.

Structure of Side Plate

As shown in FIGS. 9 and 11, a guide groove 135*a* is formed in each of the side plates 135 and a guide groove 136*a* is formed on each of the side plates 136 so as to guide the image forming cartridge 140 in the direction of insertion of the cartridge (the direction indicated by arrow A of FIGS. 9 and 11).

Figure 12:
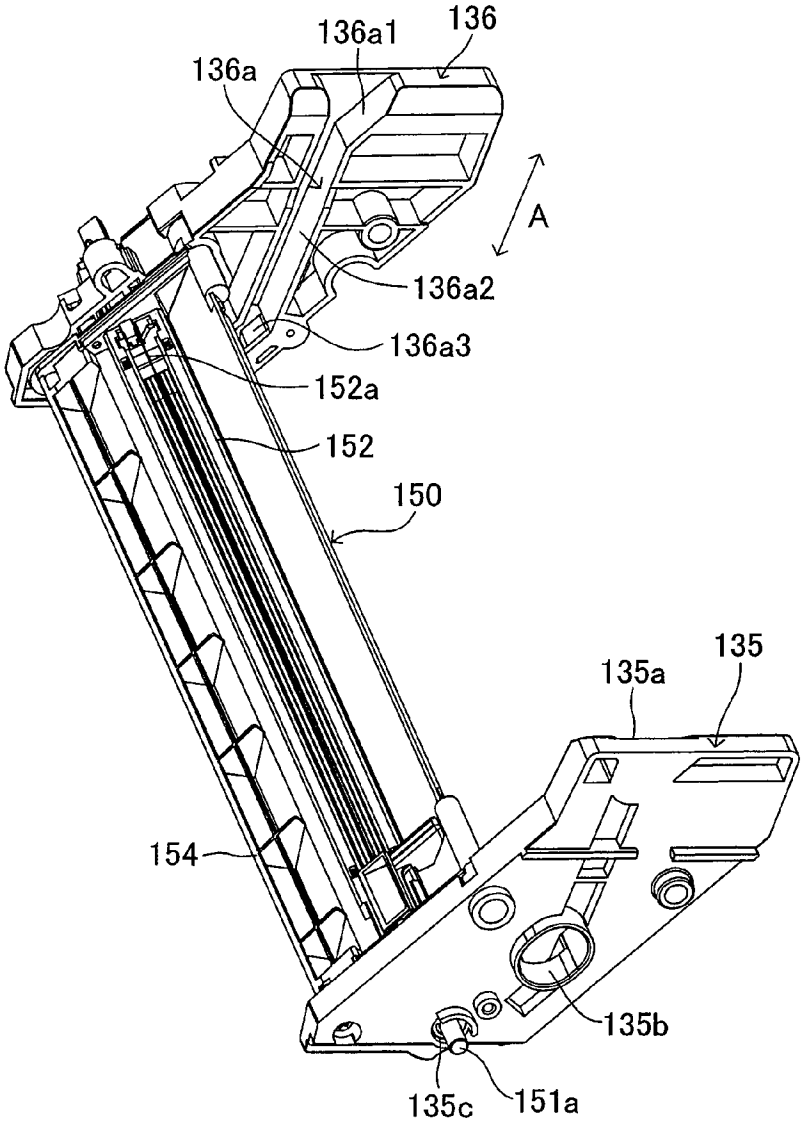
FIG. 12 is a perspective view of a pair of the side plates and the drum unit removed from the structure shown in FIG. 11.
Figure 13:
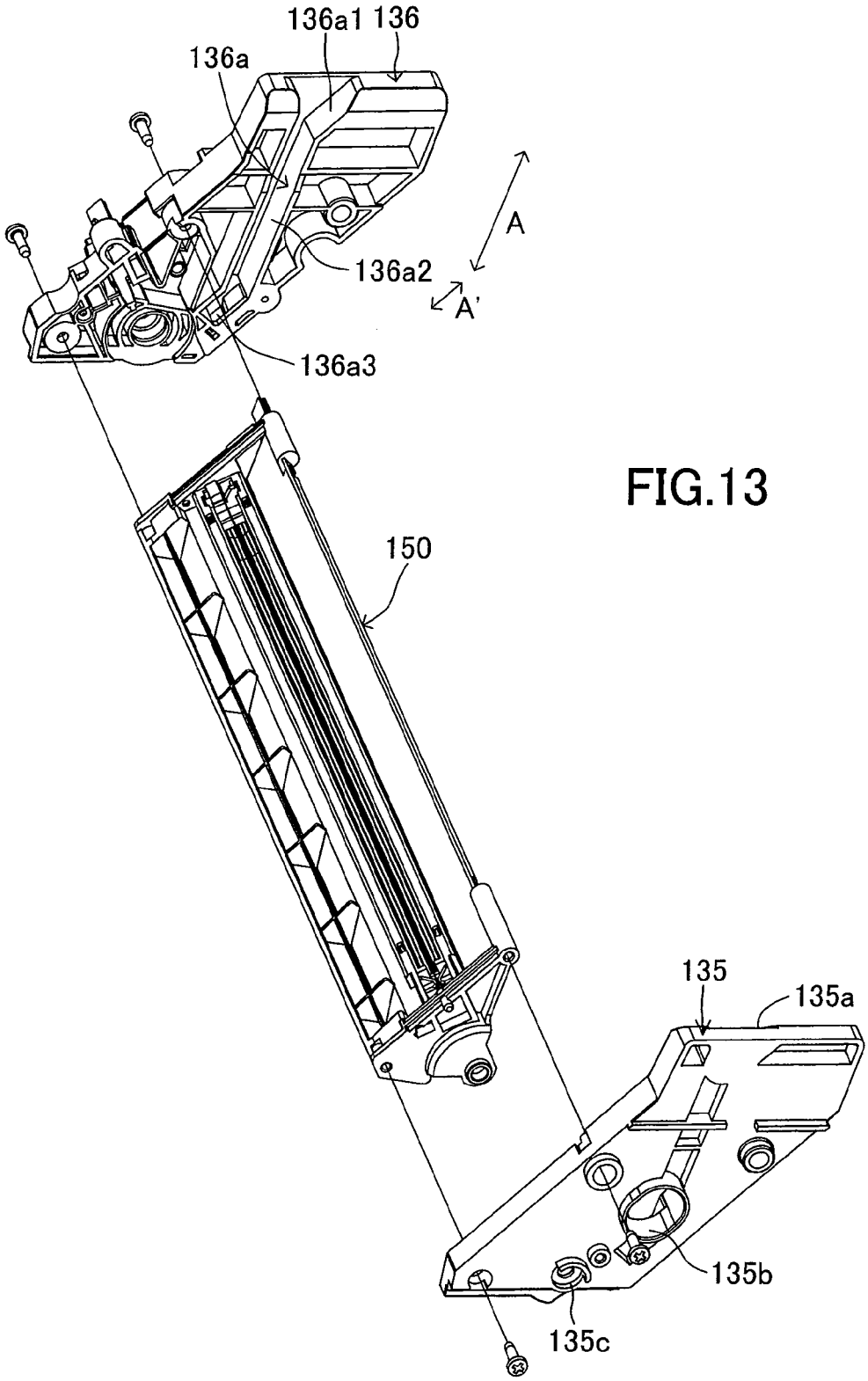
FIG. 13 is a perspective view of the pair of the side plates and the drum unit when the pair of the side plates and the drum unit shown in FIG. 12 are disassembled.

As shown in FIG. 11, the drum unit 150 (see FIG. 5) is supported between the side plates 135 and 136. FIG. 12 is a perspective view of a pair of the side plates 135 and 136 and the drum unit 150 removed from the structure shown in FIG. 11. FIG. 13 is a perspective view of the pair of the side plates 135 and 136 and the drum unit 150 when the pair of the side plates 135 and 136 and the drum unit 150 shown in FIG. 12 are disassembled.

As shown in FIG. 11, a coupling exposure section 135*b* corresponding to the coupling through-hole 132*b* of the supporting plate 132 is formed on the side plate 135. As shown in FIGS. 12 and 13, the coupling exposure section 135*b* is a short tube that extends outwardly from the side wall of the side plate 135. As shown in FIG. 11, the coupling exposure section 135*b* is inserted into the corresponding coupling through-hole 132*b* of the supporting plate 132.

As shown in FIGS. 12 and 13, a drum center shaft insertion hole 135*c* is formed in the lower section of the side plate 135. As shown in FIG. 12, the photoconductive-drum rotation center shaft 151*a* is disposed in the drum center shaft insertion hole 135*c*.

The guide groove 136*a* formed on the side plate 136 includes a lead-in portion 136*a*1, a guide portion 136*a*2, and a supporting portion 136*a*3. It is noted that the guide groove 135*a* of the side plate 135 has a similar structure.

The lead-in portion 136a1 is formed so as to be open in, substantially, a "V-shape" in side view. The lead-in portion 136a1 facilitates the easy insertion of the collar member 147 into the guide groove 136a when the image forming cartridge 140 is mounted in the slide frame 130, as shown in FIG. 9.

Referring back to FIGS. 12 and 13, the guide portion 136a2 extends obliquely downward from the lower end of the lead-in portion 136a1. The guide portion 136a2 is formed so as to be parallel to the direction of insertion of the cartridge (the direction indicated by arrow A of FIGS. 12 and 13). The supporting portion 136a3 extends obliquely downward and backward (in a direction indicated by arrow A' of FIG. 13) from the lower end of the guide portion 136a2. As shown in FIG. 9, the supporting portion 136a3 is formed so as to support the collar member 147 when the image forming cartridge 140 is mounted in the slide frame 130. The supporting portion 136a3 is a relatively short groove having a length slightly larger than the outer diameter of the collar member 147.

That is, as shown in FIGS. 9 and 13, the side plate 136 can guide the collar member 147 (see FIG. 9) using the guide portion 136a2 in the direction indicated by arrow A. Subsequently, the side plate 136 can guide the collar member 147 using the supporting portion 136a3 in the direction indicated by arrow A'.

Figure 14B:
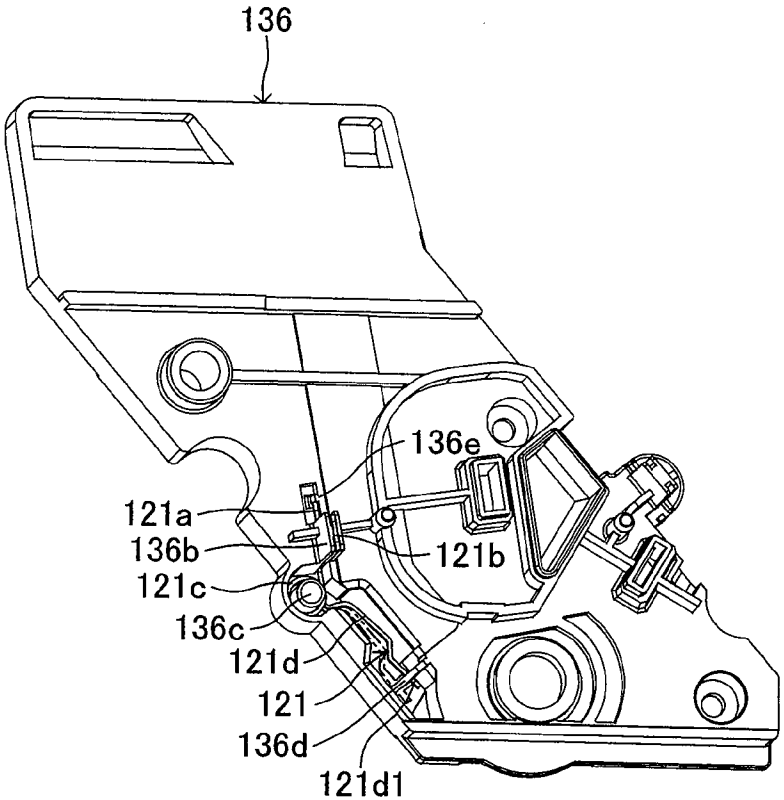
FIG. 14A is a perspective view of the side plate when viewed from inside the slide frame and FIG. 14B is a perspective view of the side plate when viewed from outside the slide frame.
Figure 14A:
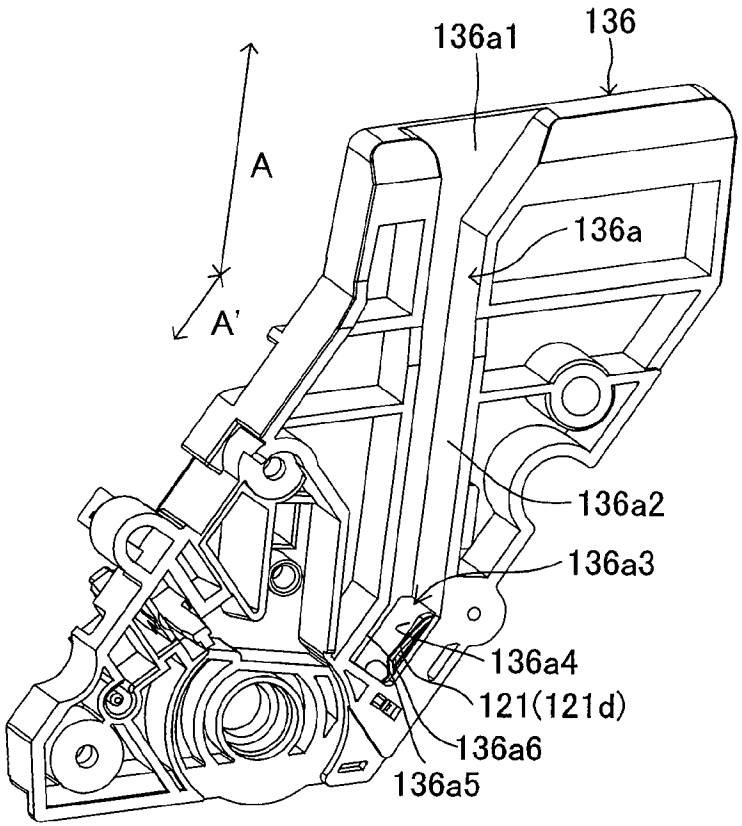

Detailed Configuration of Electric Connecting Part Between Image Forming Cartridge and Slide Frame FIGS. 14A and 14B are perspective views of the side plate 136 shown in FIG. 13. FIG. 14A is a perspective view of the side plate 136 when viewed from inside (the side of the drum unit 150 shown in FIG. 13 or inside of the slide frame 130 shown in FIG. 11). FIG. 14B is a perspective view of the side plate 136 when viewed from outside (outside the slide frame 130 shown in FIG. 11).

As shown in FIG. 14A, an electrode exposure opening 136a4 is formed in the bottom of the supporting portion 136a3 that faces the lower end of the guide portion 136a2. The electrode exposure opening 136a4 serves as a through-hole for communicating with outside the side plate 136 (the side shown in FIG. 14B). As shown in FIG. 14B, an electrode member 121 is mounted outside the outer surface of the side plate 136 at a position near the supporting portion 136a3. The electrode exposure opening 136a4 allows part of the electrode member to protrude into the interior of the supporting portion 136a3.

Positioning end surfaces 136a5 and 136a6 are formed on the supporting portion 136a3. The positioning end surface 136a5 includes a wall surface of the supporting portion 136a3 that faces the electrode exposure opening 136a4. The positioning end surface 136a6 includes a wall surface of the end of the guide groove 136a. When the peripheral surface of the collar member 147 (see FIG. 9) is in contact with the positioning end surfaces 136a5 and 136a6, the position of the image forming cartridge 140 (see FIG. 9) with respect to the slide frame 130 (see FIG. 9) can be determined.

Detailed Structure of Electrode Member

Figure 15:
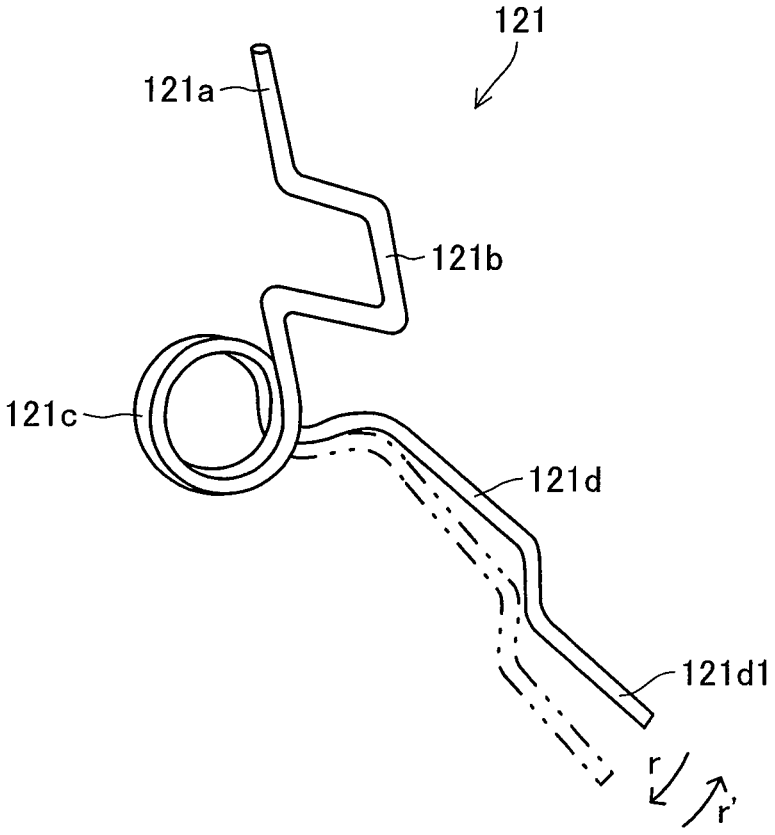
FIG. 15 is an enlarged perspective view of an electrode member shown in FIG. 14B.

FIG. 15 is an enlarged perspective view of the electrode member 121 shown in FIG. 14B. The electrode member 121 electrically connects the image forming cartridge 140 shown in FIG. 1 to the body frame 112. The electrode member 121 is mounted on the slide frame 130.

As shown in FIGS. 14B and 15, the electrode member 121 is formed as a torsion coil spring. The electrode member 121 is formed from a steel wire into one component. The electrode member 121 includes a base end portion 121a, a body-side contact portion 121b, a connection coil spring portion 121c, and a cartridge-side contact portion 121d.

The base end portion 121a and the body-side contact portion 121b function as one arm portion of the torsion coil spring. This arm portion extends outwardly from the connection coil spring portion 121c. The body-side contact portion 121b is provided between the base end portion 121a and the connection coil spring portion 121c. The body-side contact portion 121b has substantially a "U-shape". The body-side contact portion 121b extends perpendicularly from a plane that is parallel to the base end portion 121a and the connection coil spring portion 121c.

The cartridge-side contact portion 121d functions as the other arm portion of the torsion coil spring. This arm portion extends outwardly from the connection coil spring portion 121c.

The connection coil spring portion 121c connects the body-side contact portion 121b to the cartridge-side contact portion 121d. When the cartridge-side contact portion 121d is pressed in a direction indicated by arrow r of FIG. 15 and rotates to a position indicated by a chain double-dashed line, the connection coil spring portion 121c can press against the cartridge-side contact portion 121d in a direction indicated by arrow r' of FIG. 15.

Supporting Structure of Electrode Member

As shown in FIG. 14B, a body-side contact supporting portion 136b, a coil supporting portion 136c, a leg guide portion 136d, and a base-end supporting portion 136e are formed on the outer surface of the side plate 136.

The body-side contact supporting portion 136b can support the body-side contact portion 121b while allowing a substantially middle portion of the body-side contact portion 121b (a portion parallel to the base end portion 121a and the connection coil spring portion 121c) to protrude outwardly. The coil supporting portion 136c allows the connection coil spring portion 121c to pass therethrough so as to support the connection coil spring portion 121c. The leg guide portion 136d is formed from a plate extending outwardly. The leg guide portion 136d can guide the swing movement of an arm end 121d1, which is an end of the cartridge-side contact portion 121d, about a center axis of the connection coil spring portion 121c. The base-end supporting portion 136e locks the base end portion 121a so as to support the base end portion 121a.

Detailed Configuration of Electrical Connection of Electrode Member

Figure 16:
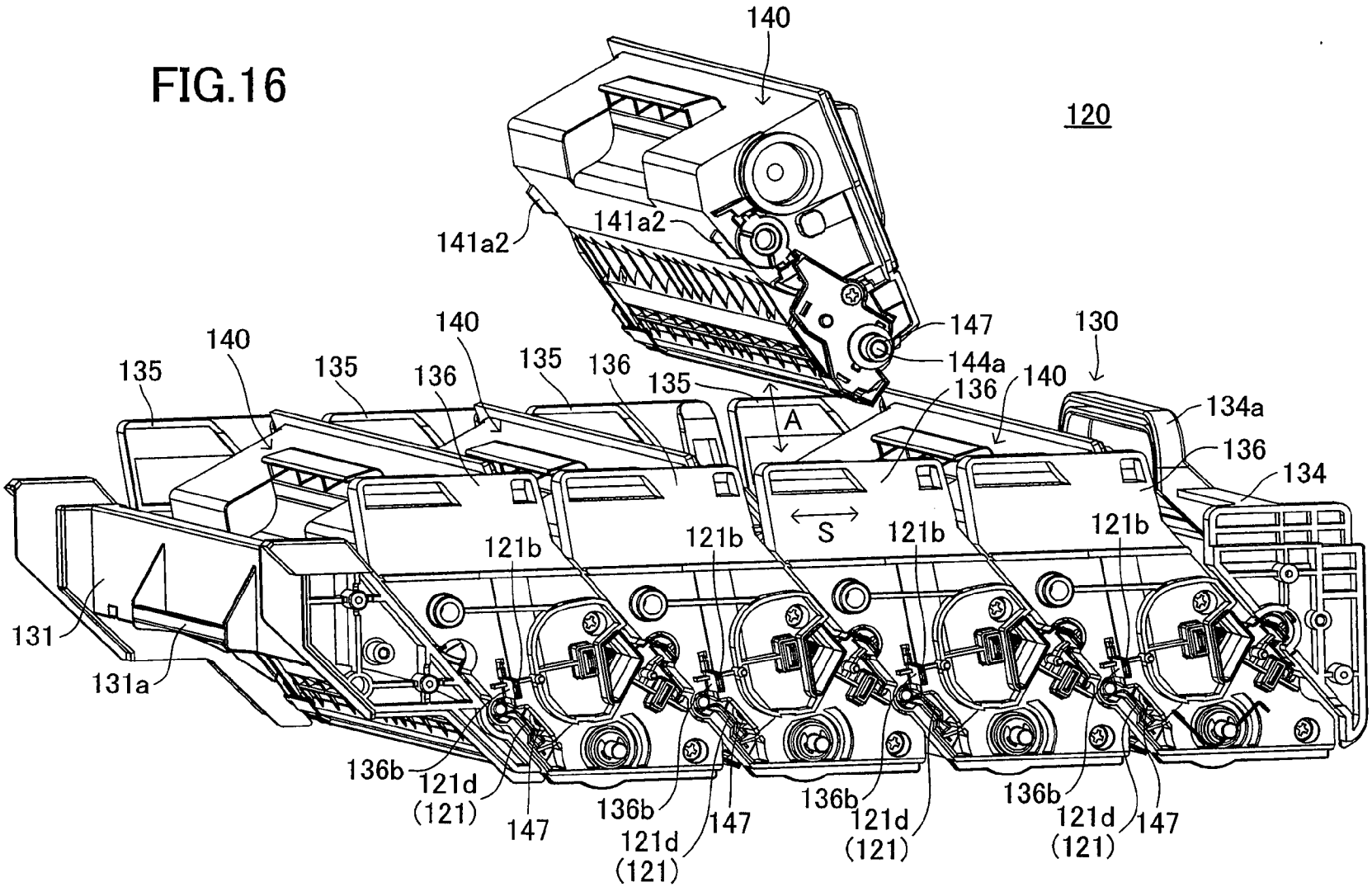
FIG. 16 is a partial exploded perspective view of the color image forming unit shown in FIG. 9.
Figure 17:
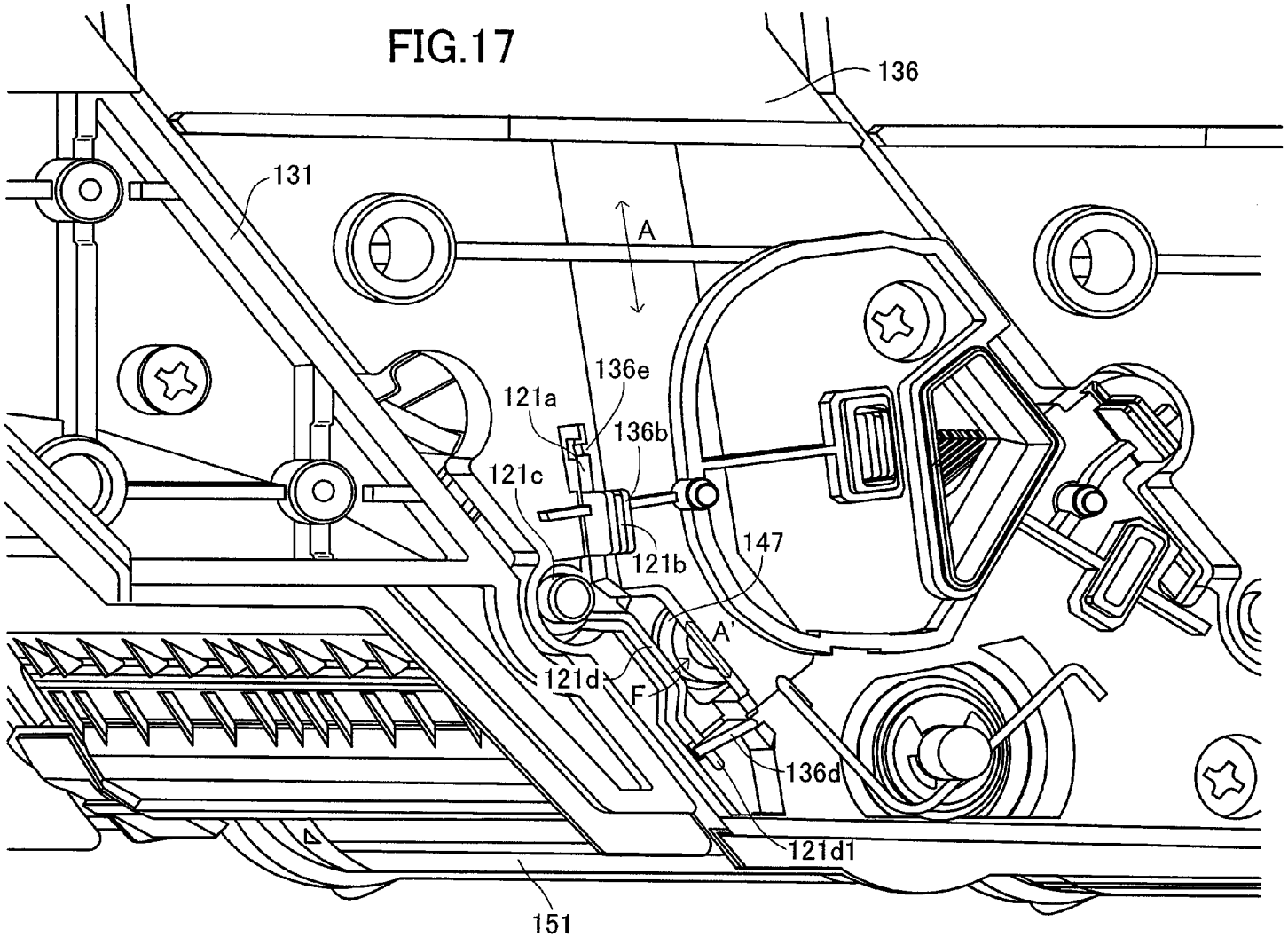
FIG. 17 is a perspective view of a main portion of the outer surface of the side plate shown in FIG. 16.

FIG. 16 is a partial exploded perspective view of the color image forming unit 120 shown in FIG. 9. FIG. 17 is a perspective view of a main portion of the outer surface of the side plate 136 shown in FIG. 16.

As shown in FIG. 16, when the image forming cartridge 140 is mounted on the slide frame 130, the cartridge-side contact portion 121d of the electrode member 121 presses against the collar member 147 of the image forming cartridge 140 at a predetermined pressure. Additionally, when the cartridge-side contact portion 121d is in contact with the collar member 147, electrical connection between the cartridge-side contact portion 121d of the electrode member 121 and the development-roller rotation center shaft 144a is achieved.

More specifically, as shown in FIG. 16, the cartridge-side contact portion 121d is disposed so as to protrude towards the image forming cartridge 140. As shown in FIG. 17, the electrode member 121 is configured so that the cartridge-side contact portion 121d presses against the collar member 147 in a direction indicated by arrow F of FIG. 17. The direction indicated by arrow F crosses the direction of insertion of the cartridge (the direction indicated by arrow A of FIG. 17). In addition, the direction indicated by arrow F is substantially perpendicular to the swing direction of the collar member 147 (a swing direction of the cartridge indicated by arrow A' of FIG. 17). This swing direction of the cartridge is the same as the direction indicated by arrow A' shown in FIGS. 13 and 14.

Referring back to FIG. 16, a plurality of the electrode members 121 corresponding to a plurality of the image forming cartridges 140 are aligned along the sliding direction (a direction indicated by arrow S), which is a direction in which the image forming cartridges 140 are aligned.

Figure 18:
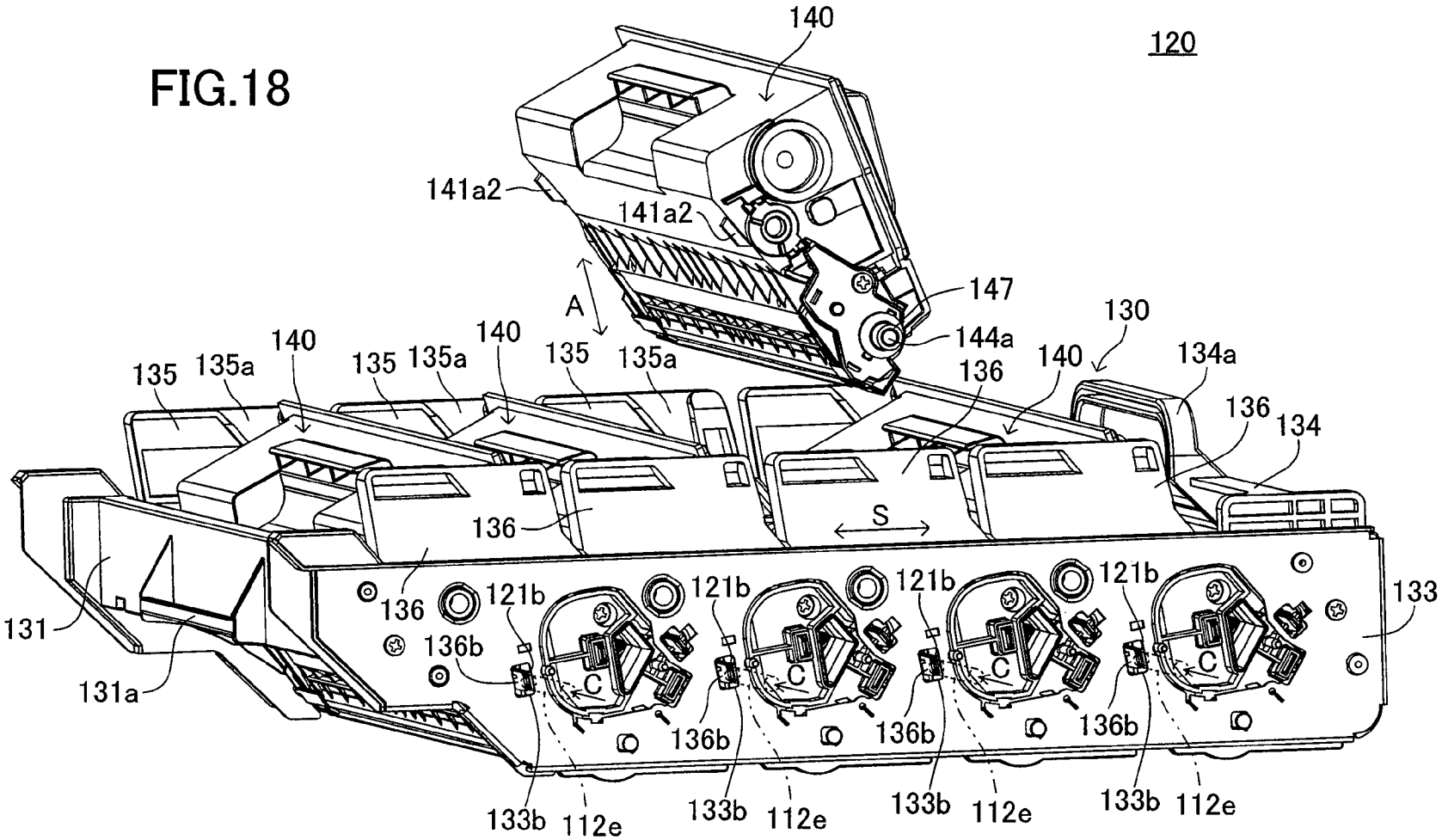
FIG. 18 is a perspective view of the color image forming unit and the image forming cartridge shown in FIG. 9 when the image forming cartridge is mounted on or dismounted from the color image forming unit.

FIG. 18 is a perspective view of the color image forming unit 120 and the image forming cartridge 140 shown in FIG. 9 when the image forming cartridge 140 is mounted on or dismounted from the color image forming unit 120. That is, FIG. 16 is a view obtained when the supporting plate 133 is removed from the view shown in FIG. 18.

As shown in FIG. 18, electrode through-holes 133*b* are formed in the supporting plate 133. Each of the electrode through-holes 133*b* allows the body-side contact portion 121*b* and the body-side contact supporting portion 136*b* to protrude towards a body frame contact 112*e* provided on the body frame 112 (see FIG. 1).

The body frame contact 112*e* is disposed so as to protrude towards the slide frame 130 (the color image forming unit 120). When the body frame contact 112*e* presses against the body-side contact portion 121*b* in a direction indicated by arrow C of FIG. 18, the body frame contact 112*e* is in contact with the body-side contact portion 121*b*, and therefore, the body frame contact 112*e* is electrically connected to the body-side contact portion 121*b*. The direction indicated by arrow C in which the body frame contact 112*e* presses against the body-side contact portion 121*b* is perpendicular to the sliding direction (a direction indicated by arrow S) and the direction of insertion of the cartridge (a direction indicated by arrow A). That is, the direction indicated by arrow C is the above-described width direction. As shown in FIGS. 17 and 18, the direction indicated by arrow C of FIG. 18 is perpendicular to the direction indicated by arrow F of FIG. 17.

OPERATION OF STRUCTURE ACCORDING TO PRESENT EMBODIMENT

The operation of the structure according to the present embodiment is described below with reference to the accompanying drawings.

Image Forming Operation

First, the image forming operation performed by the color laser printer 100 according to this embodiment is described with reference to FIG. 4.

Paper Feed Operation

When the feed roller 183 is rotatably driven in a direction indicated by an arrow of FIG. 4, the paper sheet P placed in the feeder case 181 is fed to the separation roller 184. Thereafter, the leading edge of the paper sheet P reaches the nip formed by the separation roller 184 and the separation pad 185. By rotating the separation roller 184 in a direction indicated by an arrow of FIG. 4, only the top paper sheet P is delivered to the paper-dust removal roller 187. After the paper-dust removal roller 187 removes paper dusts on the paper sheet P, the paper sheet P passes through the sheet transport roller 191 and the sheet guide 192 and reaches the transfer unit 170.

Development Operation

When the agitator 142 is rotatably driven, toner particles in the cartridge case 141 are agitated and are delivered to the supply roller 143. The toner particles delivered to the supply roller 143 are further delivered to the development roller 144 by the supply roller 143 rotating in a direction indicated by an arrow. Subsequently, the toner particles are tribocharged at a position where the supply roller 143 is in contact with the development roller 144. Thus, the toner particles adhere to the peripheral surface of the development roller 144. The density and the charge amount of the toner particles on the peripheral surface of the development roller 144 are adjusted to predetermined values by the blade 145. Thereafter, since the development roller 144 rotates in a direction indicated by an arrow of FIG. 4, the toner particles are delivered to a position at which the development roller 144 faces the photoconductive drum 151.

After uniformly charged by the scorotron charger 152, the peripheral surface of the photoconductive drum 151 is irradiated with a laser beam in accordance with image information. Thus, an electrostatic latent image is formed on the peripheral surface of the photoconductive drum 151 in accordance with the image information. When the peripheral surface of the photoconductive drum 151 having the electrostatic latent image formed thereon faces the peripheral surface of the development roller 144 having the toner particles with a predetermined density and charge amount deposited thereon, the electrostatic latent image on the peripheral surface of the photoconductive drum 151 is developed with the toner particles. Consequently, a toner image appears on the peripheral surface of the photoconductive drum 151.

Transfer Operation

The paper sheet P delivered to the transfer unit 170 is held on the transport belt 173. Thus, the paper sheet P is transported from the front side to the back side (from right to left in FIG. 4). When the paper sheet P is delivered to the nip formed by the photoconductive drum 151 and the transfer roller 174, the toner particles on the peripheral surface of the photoconductive drum 151 are transferred to the paper sheet P by means of a transfer bias voltage between the photoconductive drum 151 and the transfer roller 174.

Fixing and Paper Ejection Operations

After the toner particles are deposited on the surface of the paper sheet P in the transfer unit 170, the paper sheet P is delivered to the fixing unit 193. Thereafter, the paper sheet P is pinched by the heat roller 193*a* and the pressure roller 193*b* and is heated. Thus, the toner particles deposited on the paper sheet P are fused onto the surface of the paper sheet P. Subsequently, the paper sheet P is ejected to the catch tray 111*b* outside the body section 110 by the paper ejection roller 197.

Mount/Dismount Operation of Unit

The mount and dismount operations of the color image forming unit 120 in the color laser printer 100 are described next.

As shown in FIG. 1, when the front cover 111*e* is open toward the front side (the proximal side), the color image forming unit 120 is exposed to outside through the front opening 111*d*. Subsequently, when the front-side grip 131*a* of the slide frame 130 is pulled out towards the proximal side along the sliding direction (the direction indicated by arrow S of FIG. 1), the color image forming unit 120 is pulled out to the proximal side, as shown in FIG. 2. Thus, the image forming cartridge 140 exposed to outside can be removed.

When the color image forming unit 120 is further pulled out towards the proximal side, the color image forming unit 120 can be completely removed to outside the body section 110, as shown in FIG. 3. Thus, the color image forming unit 120 is interchangeable.

Mount/Dismount Operation of Cartridge

The mount and dismount operations of the image forming cartridge 140 to and from the color image forming unit 120 in the color laser printer 100 are described next.

Figure 19:
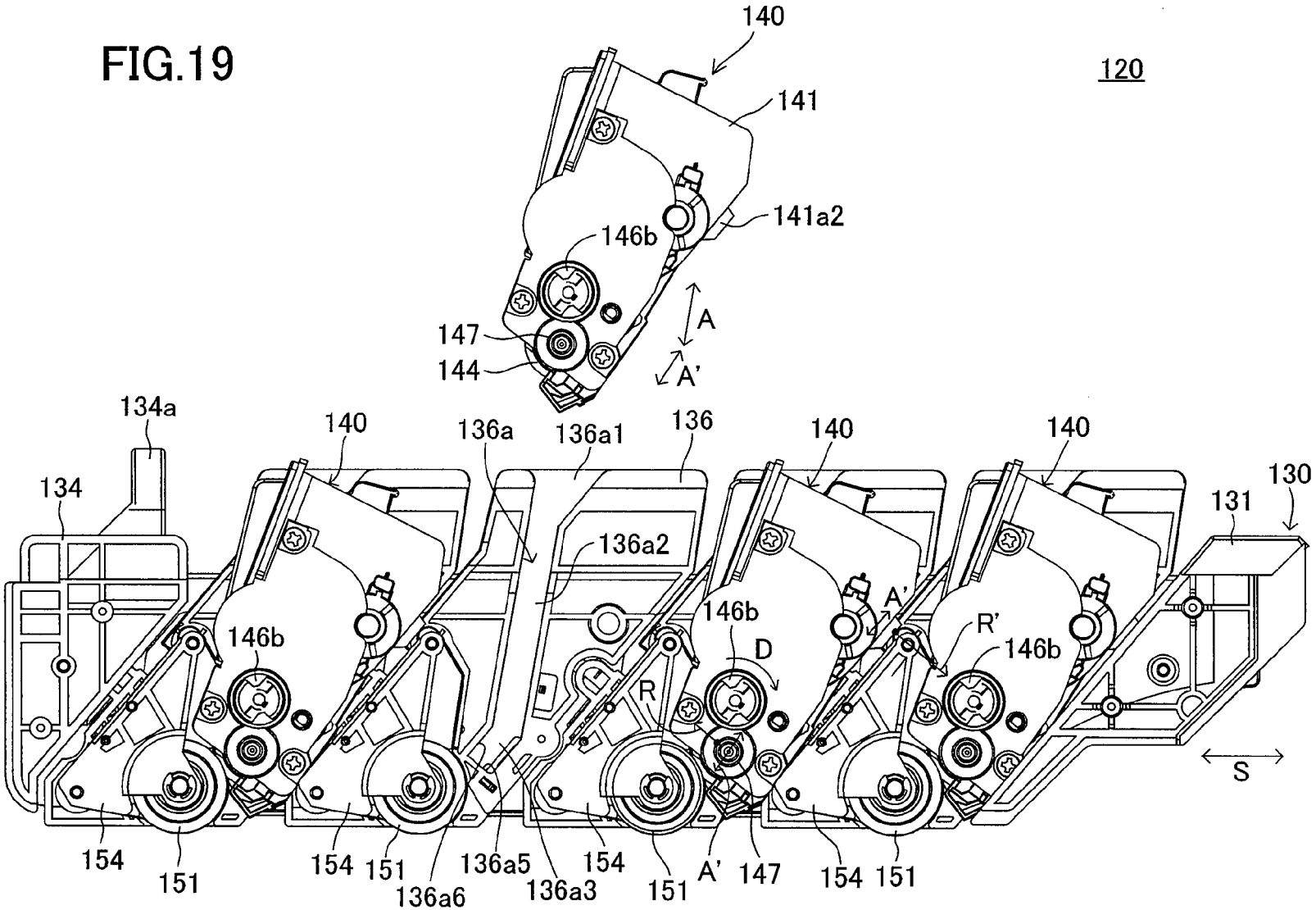
FIG. 19 is a partial exploded side elevational view of the color image forming unit shown in FIG. 10.

FIG. 19 is a side elevational view of the color image forming unit 120 shown in FIG. 10 when the color image forming unit 120 is partially disassembled and the image forming cartridge 140 is mounted in or dismounted from the slide frame 130. First, the mount operation of the image forming cartridge 140 in the slide frame 130 is described with reference to FIGS. 17 to 19.

As shown in FIGS. 18 and 19, the collar member 147 extending outwardly from either side of the image forming cartridge 140 in the width direction of the image forming cartridge 140 is inserted into the upper end of the guide grooves 135*a* and 136*a* (i.e., the lead-in portion 136*a*1). Subsequently, when the image forming cartridge 140 is moved downward, the collar member 147 is guided obliquely downward along the direction of insertion of the cartridge indicated by arrow A of FIGS. 18 and 19 by the guide portion 136*a*2. Thus, the image forming cartridge 140 is inserted into a space between the side plates 135 and 136 along the direction of insertion of the cartridge indicated by arrow A of FIGS. 18 and 19.

When the collar member 147 passes through the lower end of the guide portion 136*a*2 and reaches the supporting portion 136*a*3, the collar member 147 is guided obliquely downward along the swing direction of the cartridge indicated by arrow A' of FIG. 19 by the supporting portion 136*a*3. Thus, the image forming cartridge 140 is mounted on the slide frame 130.

As shown in FIG. 17, when the image forming cartridge 140 is mounted on the slide frame 130, the cartridge-side contact portion 121*d* is in contact with the collar member 147. Thus, the electrode member 121 is electrically connected to the collar member 147 (the image forming cartridge 140 shown in FIGS. 18 and 19). Additionally, as shown in FIGS. 17 and 18, the body-side contact portion 121*b* of the electrode member 121 is in contact with the body frame contact 112*e*. Thus, the electrode member 121 is electrically connected to the body frame contact 112*e* (the body section 110 shown in FIG. 1). In this way, electrical connection between the body frame contact 112*e* (the body section 110 shown in FIG. 1) and the collar member 147 (the image forming cartridge 140 shown in FIGS. 1, 18, and 19) is achieved via the electrode member 121 attached on the slide frame 130.

Positioning of Image Forming Cartridge

As shown in FIG. 17, in the supporting portion 136*a*3, the collar member 147 is pressed by the cartridge-side contact portion 121*d* of the electrode member 121 in the direction indicated by arrow F of FIG. 17. The pressing force and the weight of the image forming cartridge 140 cause the outer periphery of the collar member 147 to be brought into contact with the positioning end surfaces 136*a*5 and 136*a*6 at a predetermined pressure. Thus, the position of the image forming cartridge 140 relative to the slide frame 130 is determined. That is, a positional relationship between the photoconductive drum 151 and the development roller 144 is set to predetermined conditions.

As shown in FIG. 19, when a rotational driving force is provided to the coupling gear 146*b* in a direction indicated by arrow D of FIG. 19, a couple of forces act on the image forming cartridge 140 in the direction indicated by arrow D. Accordingly, the collar member 147 is urged in a direction indicated by arrow R of FIG. 19 (the seventh direction in the present invention). Thus, the collar member 147 is urged against the positioning end surface 136*a*6. The direction indicated by arrow R is substantially the same as the direction indicated by arrow F of FIG. 17.

That is, when the rotational driving force is provided to the coupling gear 146*b* in the direction indicated by arrow D of FIG. 19, a force acts on the image forming cartridge 140 in a direction so that the positioning of the image forming cartridge 140 with respect to the slide frame 130 (i.e., the positioning between the photoconductive drum 151 and the development roller 144) is ensured.

Advantages of Structure According to Present Embodiment

The advantages of the structure according to the present embodiment are described next.

As shown in FIG. 18, according to the structure of the present embodiment, the body-side contact portion 121*b* of the electrode member 121 is disposed so as to protrude towards the body frame 112. Additionally, the electrode member 121 is attached to the side plate 136 (the slide frame 130). A plurality of the electrode members 121, each corresponding to one of the image forming cartridges 140, are aligned along the sliding direction (the direction indicated by arrow S).

In such a structure, by simply mounting the slide frame 130 on the body frame 112, electrical connection between the body section 110 and the image forming cartridge 140 mounted on the slide frame 130 is achieved. In addition, according to this structure, by simply pulling out the slide frame 130 from the body frame 112 in the sliding direction (the direction indicated by arrow S), the body section 110 is electrically disconnected from the image forming cartridge 140. As noted above, according to this structure, the electrical connection and disconnection between the body section 110 and the image forming cartridge 140 are provided in conjunction with the relative movement between the body section 110 and the slide frame 130 (the color image forming unit 120). Accordingly, the electrical connection between the body section 110 and the image forming cartridge 140 can be easily achieved using a simple structure. Consequently, this structure can facilitate the maintenance of the color laser printer 100.

As shown in FIG. 19, according to the structure of the present embodiment, when the slide frame 130 is mounted on or dismounted from the body frame 112, the sliding direction (the direction indicated by arrow S) is substantially perpendicular to the directions in which the image forming cartridge 140 is mounted on and dismounted from the slide frame 130 (i.e., the directions indicated by arrows A and A').

In such a structure, when the slide frame 130 slides in the sliding direction (the direction indicated by arrow S), the mounting state of the image forming cartridge 140 on the slide frame 130 tends to remain unchanged. Thus, when the slide frame 130 is inserted into the body frame 112 along the sliding direction (the direction indicated by arrow S), a loose electrical connection between the cartridge-side contact portion 121*d* and the collar member 147 caused by a positional shift of the slide frame 130 from the image forming cartridge 140 can be inhibited. Accordingly, reliable electrical contact between the body section 110 and the image forming cartridge 140 can be achieved.

As shown in FIGS. 16 and 18, according to the structure of the present embodiment, the cartridge-side contact portion 121*d* is disposed on the inner surface of the slide frame 130. Additionally, the cartridge-side contact portion 121*d* protrudes from the inner surface of the slide frame 130 towards the image forming cartridge 140. In contrast, the body-side contact portion 121*b* is disposed so as to protrude towards the body frame contact 112*e* outside the supporting plate 133 (the slide frame 130) through the electrode through-hole 133*b*.

In such a structure, part of the electrode member 121 that extends to outside the slide frame 130 is limited to the body-side contact portion 121*b*. Accordingly, mechanical interference between the body frame contact 112*e* provided on the body frame 112 and the cartridge-side contact portion 121*d* is inhibited. Thus, in this structure, reliable electrical connection between the body section 110 and the slide frame 130 and reliable electrical connection between the slide frame 130 and the image forming cartridge 140 can be achieved.

As shown in FIG. 3, according to the structure of the present embodiment, the slide frame 130 is removably mounted on the body frame 112. That is, the color image forming unit 120 is completely detached from the body section 110. Thus, the color image forming unit 120 is interchangeable.

Consequently, this structure can facilitate the maintenance of the color laser printer 100.

As shown in FIG. 18, according to the structure of the present embodiment, since the body-side contact portion 121*b* is urged in a direction indicated by arrow C that is substantially perpendicular to the sliding direction (the direction indicated by arrow S), the body-side contact portion 121*b* is in contact with the body frame contact 112*e*.

According to such a structure, reliable electrical connection between the body frame contact 112*e* and the body-side contact portion 121*b* can be achieved using the simple structure.

As shown in FIGS. 16 and 17, according to the structure of the present embodiment, when the image forming cartridge 140 is mounted and dismounted, the direction in which the cartridge swings (the direction indicated by arrow A' of FIG. 17) is substantially perpendicular to the direction in which the collar member 147 is urged by the cartridge-side contact portion 121*d* (the direction indicated by arrow F of FIG. 17).

According to such a structure, the mount and dismount operation of the image forming cartridge 140 and positioning of the image forming cartridge 140 relative to the slide frame 130 are not affected by the pressure between the cartridge-side contact portion 121*d* and the collar member 147. Accordingly, the mount and dismount operation of the image forming cartridge 140 can be smoothly carried out. In addition, reliable electrical connection between the cartridge-side contact portion 121*d* and the collar member 147 can be achieved using the simple structure.

As shown in FIGS. 17 and 18, according to the structure of the present embodiment, the electrode member 121 is configured so that the direction in which the cartridge-side contact portion 121*d* and the collar member 147 press each other is substantially perpendicular to the direction in which the body-side contact portion 121*b* and the body frame contact 112*e* press each other.

According to such a structure, compared with the case where the direction in which the cartridge-side contact portion 121*d* and the collar member 147 press each other is parallel to the direction in which the body-side contact portion 121*b* and the body frame contact 112*e* press each other, the size of the slide frame 130 (the color image forming unit 120) in the width direction can be further reduced.

Additionally, since the direction of an urging force acting on the body-side contact portion 121*b* is substantially perpendicular to the direction of an urging force acting on the cartridge-side contact portion 121*d*, the interference between the urging force acting on the body-side contact portion 121*b* and the urging force acting on the cartridge-side contact portion 121*d* is inhibited. Accordingly, unreliable electrical connections at the body-side contact portion 121*b* and the cartridge-side contact portion 121*d* can be inhibited. Accordingly, reliable electrical connection caused by the physical contact between the cartridge-side contact portion 121*d* and the collar member 147 can be achieved using the simple structure.

As shown in FIGS. 17 and 19, according to the structure of the present embodiment, the collar member 147 is urged towards the positioning end surfaces 136*a*5 and 136*a*6 in the directions (the directions indicated by arrows A' and R (hereinafter referred to as "predetermined positioning directions": these directions are correspond to a sixth direction in the present invention)) so that the position of the image forming cartridge 140 is determined. Such predetermined positioning directions are substantially the same as directions in which the image forming cartridge 140 (the collar member 147) receive a force when the rotational driving force is input to the coupling gear 146*b*. In addition, in FIG. 17, the direction F in which the collar member 147 is urged by the cartridge-side contact portion 121*d* is substantially the same as the direction R in which the collar member 147 receives the force when the rotational driving force is input to the coupling gear 146*b*.

According to such a structure, the positioning between the image forming cartridge 140 and the slide frame 130 can be reliably carried out.

As shown in FIG. 14, according to the structure of the present embodiment, the cartridge-side contact portion 121*d* is disposed so as to face the guide groove 136*a*.

According to such a structure, the collar member 147 of the image forming cartridge 140 is guided by the guide groove 136*a* and, subsequently, the cartridge-side contact portion 121*d* that is disposed so as to face the guide groove 136*a* is electrically connected to the collar member 147. Accordingly, the reliability of the electrical connection can be improved using the simple structure.

As shown in FIGS. 14 and 15, according to the structure of the present embodiment, the electrode member 121 includes the wire-shaped connection coil spring portion 121*c* that connects the body-side contact portion 121*b* to the cartridge-side contact portion 121*d*. The electrode member 121 is disposed in the vicinity of the guide groove 136*a* of the side plate 136.

This structure provides the following advantage. According to such a structure, the electrode member 121 can have a significantly simple structure. Additionally, since the electrode member 121 is disposed in the vicinity of the guide groove 136*a* of the side plate 136, reliable electrical connection between the cartridge-side contact portion 121*d* that faces the guide groove 136*a* and the collar member 147 can be achieved.

As shown in FIGS. 14 and 15, according to the structure of the present embodiment, the connection coil spring portion 121*c* and the cartridge-side contact portion 121*d* are integrated into the wire member having a torsion coil spring structure. The cartridge-side contact portion 121*d* functions as the arm portion extending outwardly from the coil portion of the torsion coil spring.

According to such a structure, when the collar member 147 presses against the cartridge-side contact portion 121*d* while resisting the elastic force of the torsion coil spring, the cartridge-side contact portion 121*d* is in contact with the collar member 147 and is electrically connected to the collar member 147. Thus, reliable contact and reliable electrical connection between the cartridge-side contact portion 121*d* and the collar member 147 are achieved.

As shown in FIGS. 16 and 17, according to the structure of the present embodiment, since the collar member 147 which is a conductive protrusion that can be accommodated in the guide groove 136*a* is in contact with the cartridge-side contact portion 121*d*, electrical connection between the collar member 147 and the cartridge-side contact portion 121*d* is achieved.

According to such a structure, the image forming cartridge 140 can be smoothly mounted on the slide frame 130 using the significantly simple structure. In addition, this significantly simple structure can provide reliable electrical connection between the development roller 144 and the cartridge-side contact portion 121*d*.

As shown in FIG. 9, according to the structure of the present embodiment, a plurality of the separate side plates 136 are provided so as to correspond to a plurality of the image forming cartridges 140. The separate side plates 136 are aligned along the sliding direction (the direction indicated by arrow S). Additionally, in the slide frame 130, outside the side plates 136, the supporting plate 133 is disposed so as to support the side plates 136. The body-side contact portion 121*b* is disposed so as to pass through the electrode through-hole 133*b* formed in the supporting plate 133 and be exposed outside the supporting plate 133.

According to such a structure, the side plate 136 and the guide groove 136*a* can be produced through significantly simple manufacturing steps at low cost.

As shown in FIGS. 9 and 18, according to the structure of the present embodiment, the image forming cartridge 140 is configured so that a driving force is transferred from the side of the body frame 112 via the coupling gear 146*b* disposed at one end in the width direction that is perpendicular to the sliding direction (the direction indicated by arrow S) and the directions in which the image forming cartridge 140 is mounted and dismounted (the directions indicated by arrow A and A'). In addition, the electrode member 121 is disposed so as to face the other end of the image forming cartridge 140.

According to such a structure, even when foreign materials, such as dust and grease, are generated on a portion to which the driving force is transferred in the vicinity of the coupling gear 146*b*, deposition of the foreign materials to electrical contact points between the electrode member 121 and the collar member 147 and between the electrode member 121 and the body frame contact 112*e* can be reliably inhibited. Accordingly, reliable electrical connection at the electrical contact points can be achieved.

As shown in FIG. 16, according to the structure of the present embodiment, the number of the separate electrode members 121 is equal to the number of the image forming cartridges 140.

According to such a structure, the electrode member 121 can be formed using a significantly simple structure.

Modifications

As noted above, the embodiments above provide illustrations of some of the preferred embodiments that the inventor believes to be the best mode for practicing the present invention at the time this application was filed. Therefore, these should not be construed as limiting the scope of the invention. It should be understood that many modifications are possible which remain within the concept, scope, and spirit of the invention.

Several modifications are described herewith. However, it should be understood that the modifications are not limited thereto. The above-described embodiments and the following modification should not be construed as limiting the scope of the invention because this would unfairly disadvantage the present inventor who filed the application and this would unfairly benefit an imitator of the invention.

(1) According to the present invention, an image forming apparatus is not limited to a color laser printer. For example, the present invention is applicable to a color copier.

(2) In FIGS. 17 and 19, the direction in which the collar member 147 is urged by the cartridge-side contact portion 121*d* (the direction indicated by arrow F of FIG. 17) may be a direction opposite to the positioning direction (the direction indicated by arrow R of FIG. 19). In this case, a force received by the image forming cartridge 140 (the collar member 147) for positioning urges the collar member 147 against the cartridge-side contact portion 121*d*. Thus, electrical connection between the collar member 147 and the cartridge-side contact portion 121*d* can be reliably achieved.

Figure 20:
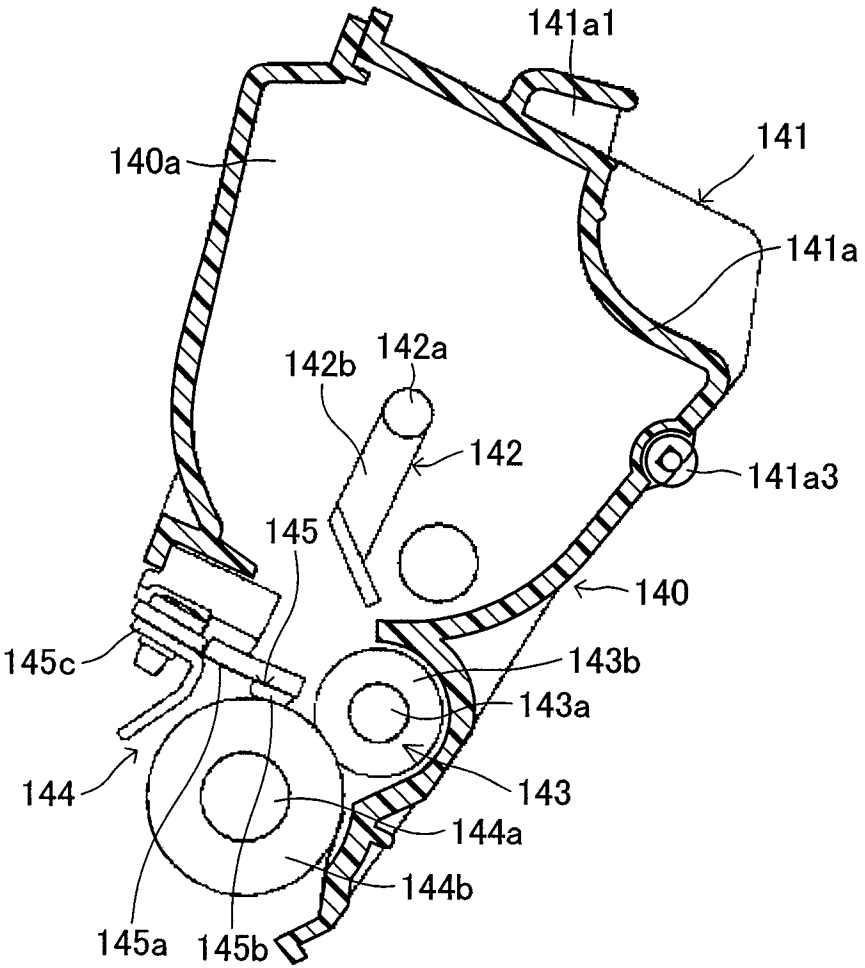
FIG. 20 is a side cross-sectional view of the structure of a modification of the image forming cartridge shown in FIG. 6.

(3) FIG. 20 is a side cross-sectional view of the structure of a modification of the image forming cartridge shown in FIG. 6. As shown in FIG. 20, in place of the leg 141*a*2 shown in FIG. 6, a roller 141*a*3 may be used.

(4) According to the present invention, operational and functional elements included in means for solving the problems include any structures that can realize the above-described embodiments and modifications as well as the specific structures described in the foregoing embodiments and modifications.

The invention claimed is:

1. An image-forming apparatus, comprising:

a main body including a plurality of first electrodes;

a slide frame supported by the main body and configured to be drawn out from the main body along a first direction, the slide frame including a plurality of second electrodes, wherein each of the plurality of second electrodes is configured to establish electrical connection to each of the plurality of first electrodes and each of a plurality of third electrodes; and a plurality of cartridges aligned along the first direction, each of the plurality of cartridges being mountable on and dismountable from the slide frame in a second direction crossing the first direction, each of the plurality of cartridges including a rotation member extending in a third direction crossing the first direction and second direction and a third electrode configured to establish electrical connection to the rotation member, wherein the slide frame includes a plurality of first walls extending in the first direction and a second wall extending in the first direction, the plurality of first walls and the second wall are disposed at a position on one side of the third direction with respect to the plurality of cartridges when the plurality of cartridges is mounted in the slide frame, wherein each of the plurality of first walls supports each of the plurality of second electrodes, and wherein the second wall supports the plurality of first walls.

2. An image-forming apparatus according to claim 1, wherein each of the plurality of first walls has an opening for exposing each of the plurality of second electrodes.

3. An image-forming apparatus according to claim 1, wherein the second wall has an opening for exposing each of the plurality of second electrodes.

4. An image-forming apparatus according to claim 1, wherein the rotation member is a development roller.

5. An image-forming apparatus according to claim 1, wherein the plurality of the second electrodes are wire-like members.

6. An image-forming apparatus according to claim 5, wherein each of the plurality of the second electrodes includes a coil portion having a shape of a coil spring and a cartridge-side contact portion provided at one end of the coil portion and configured to make contact with one of the plurality of third electrodes.

7. An image-forming apparatus according to claim 6, wherein each of the plurality of first walls includes a support portion configured to support the coil portion of the second electrode.

8. An image-forming apparatus according to claim 1, wherein the slide frame is detachably mounted to the main body.

9. An image-forming apparatus according to claim 1, wherein a number of the plurality of second electrodes is equal to a number of the plurality of cartridges.

10. An image-forming apparatus according to claim 1, wherein each of the plurality of cartridges includes a coupling member configured to receive a driving force from the main body.

* * * * *